US005600907A

United States Patent [19]

Eigenmann

[11] Patent Number: 5,600,907

[45] Date of Patent: Feb. 11, 1997

[54] METHOD AND SYSTEM OF GENERATING A VISUAL PULSATION EFFECT DISTRIBUTED ACROSS A VISUAL OR DISPLAY SURFACE

[76] Inventor: Helmut Eigenmann, Viale S. Franscini, 1A, CH-6512 Giubiasco, Switzerland

[21] Appl. No.: 94,260

[22] Filed: Jul. 19, 1993

[51] Int. Cl.[6] ..... B05B 1/26

[52] U.S. Cl. ..... 40/406; 239/20

[58] Field of Search ..... 40/406, 427, 439, 40/477; 446/267, 166; 239/18, 20, 17

[56] References Cited

U.S. PATENT DOCUMENTS

| | | | |
|---|---|---|---|
| 3,564,740 | 2/1971 | Calfee | 40/406 |
| 4,747,538 | 5/1988 | Dunn et al. | 239/20 |
| 5,005,762 | 4/1991 | Cacoub | 239/20 |
| 5,137,214 | 8/1992 | Mallery | 239/11 |

FOREIGN PATENT DOCUMENTS 0537717 4/1993 European Pat. Off. .

*Primary Examiner*—Brian K. Green
*Assistant Examiner*—Cassandra Davis
*Attorney, Agent, or Firm*—Connolly & Hutz

[57] ABSTRACT

A method to provide to a visual surface a visual pulsation effect with apparent randomness characteristics by means of the formation, and subsequent separation from a wetted supporting element, of drops of liquid, such drops possessing a high degree of constancy of size, shape and formation-separation speed. This is obtained by a determined flow of a liquid of determined characteristics over one or more supporting elements of given physical characteristics. The pulsation effect possesses a high degree of visual impact and can be used in combination with decorative patterns, messages, logotypes placed on the same visual surface as the pulsation effect.

46 Claims, 11 Drawing Sheets

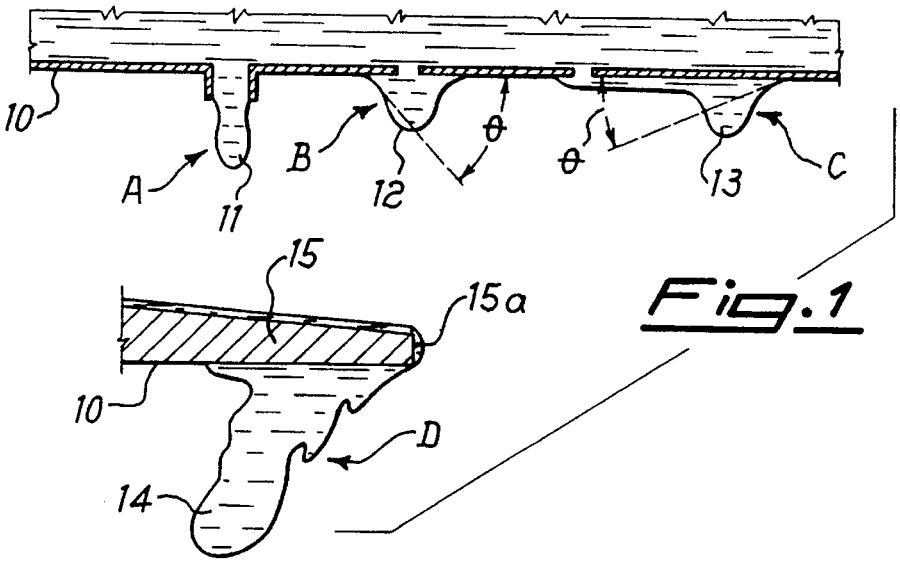
Fig. 1
Fig. 2
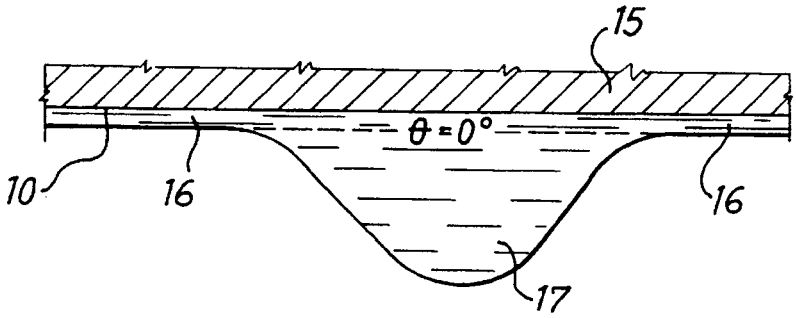
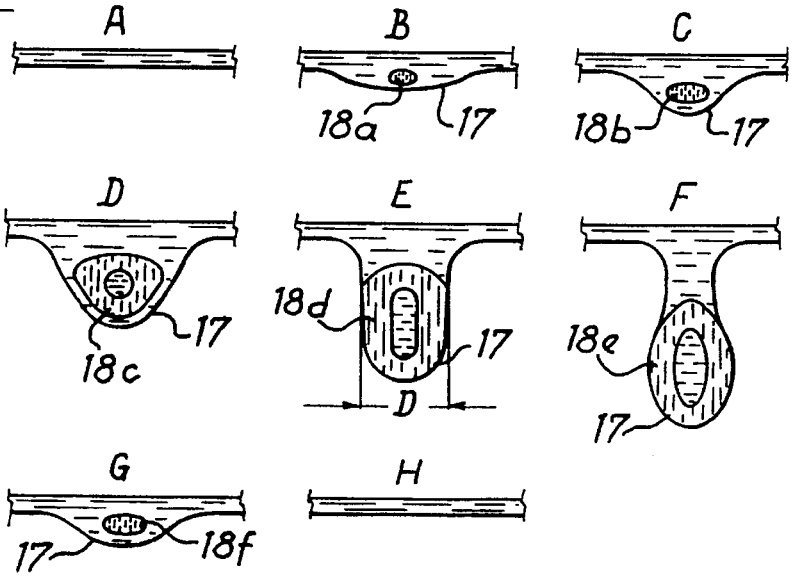
Fig. 3

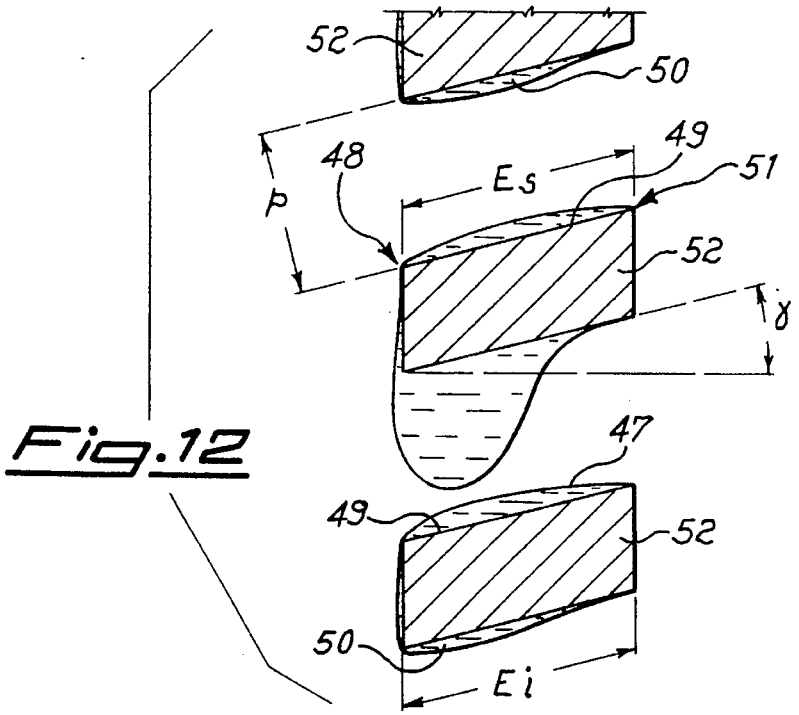
Fig.12
Fig.13
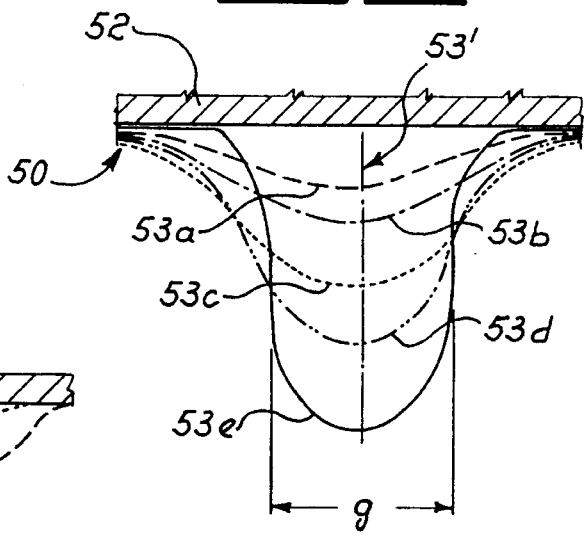
Fig.14
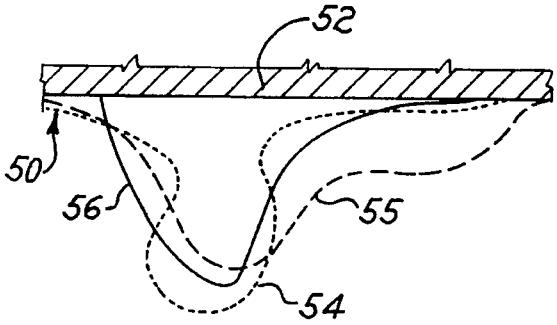

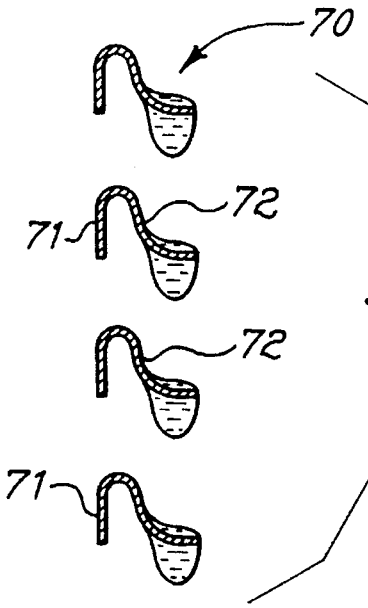
Fig. 21
Fig. 22
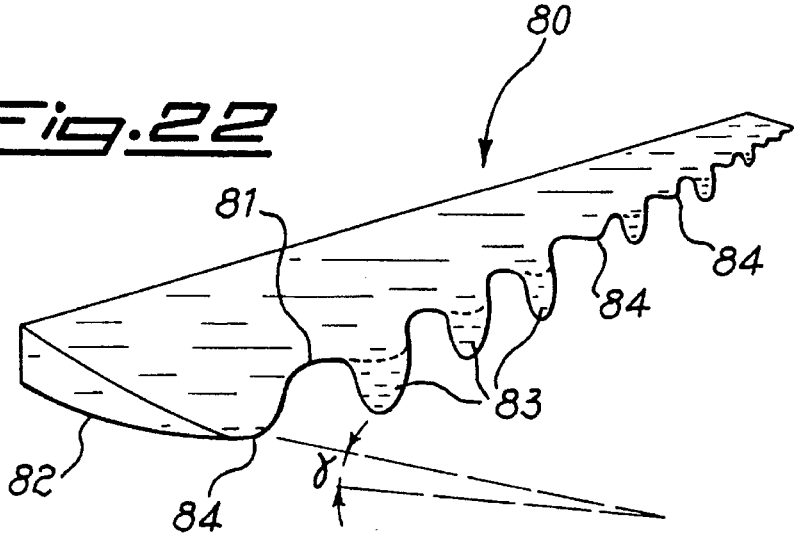
Fig. 23
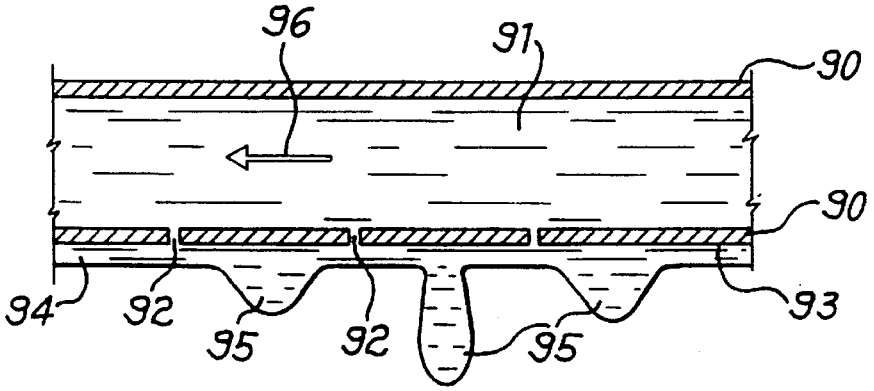

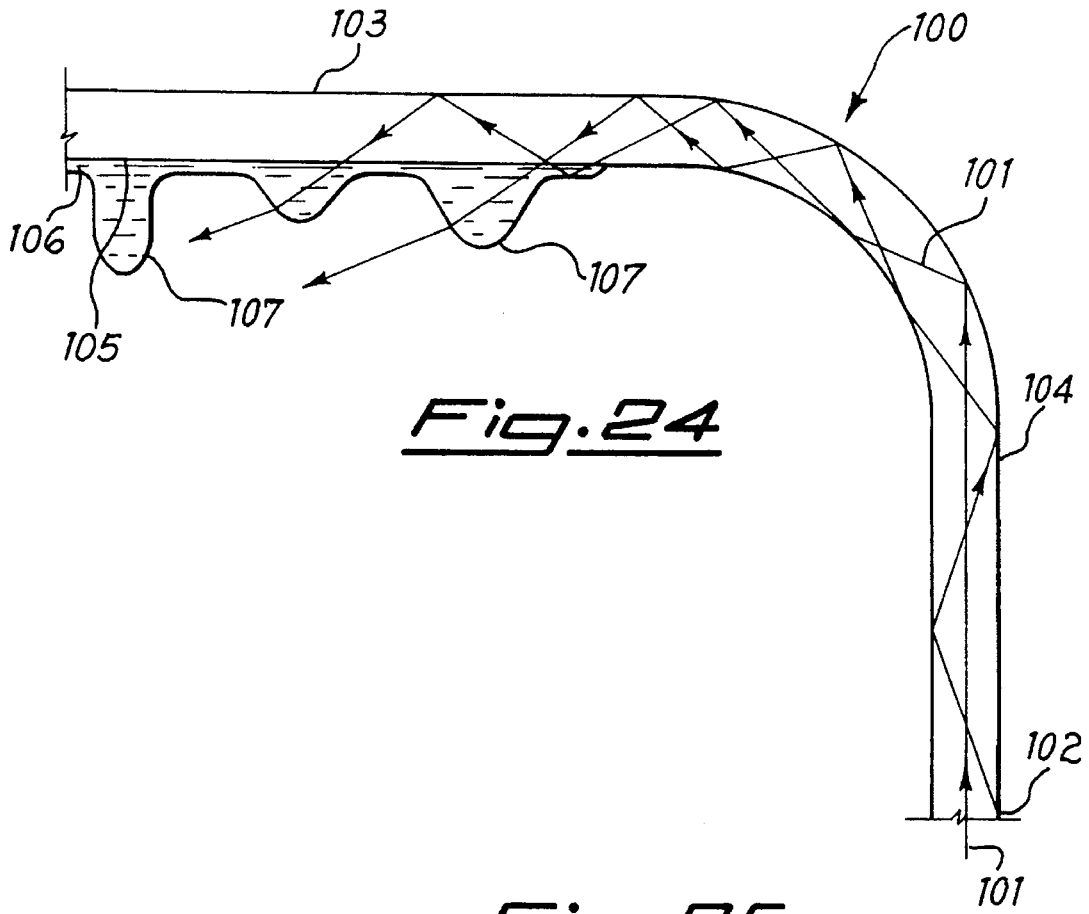
Fig. 24
Fig. 25
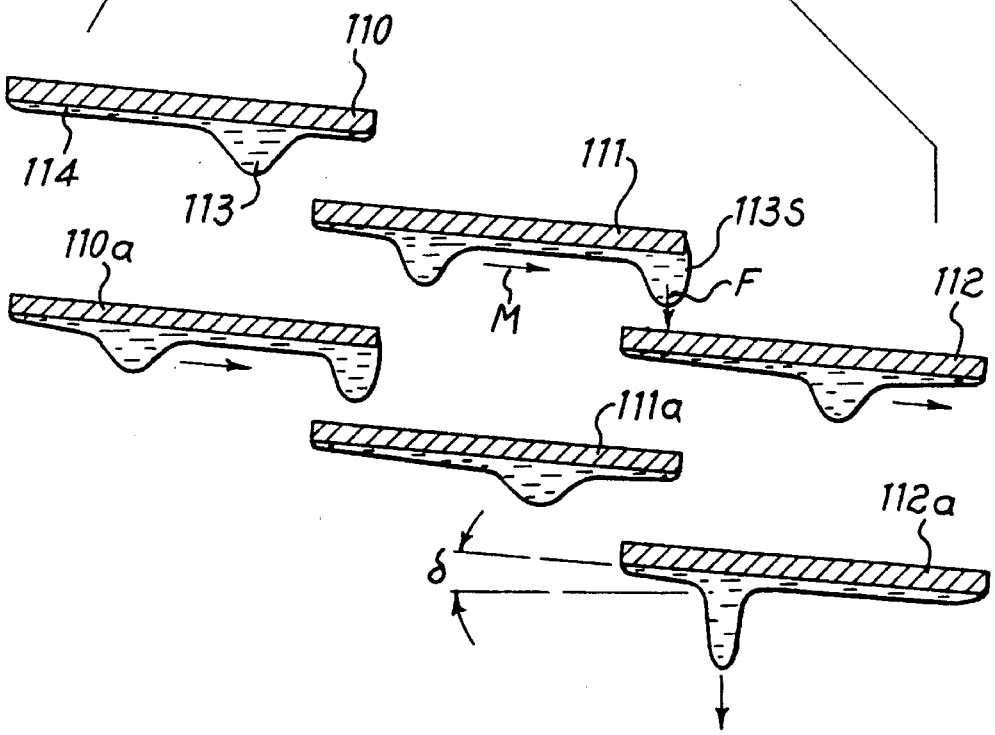

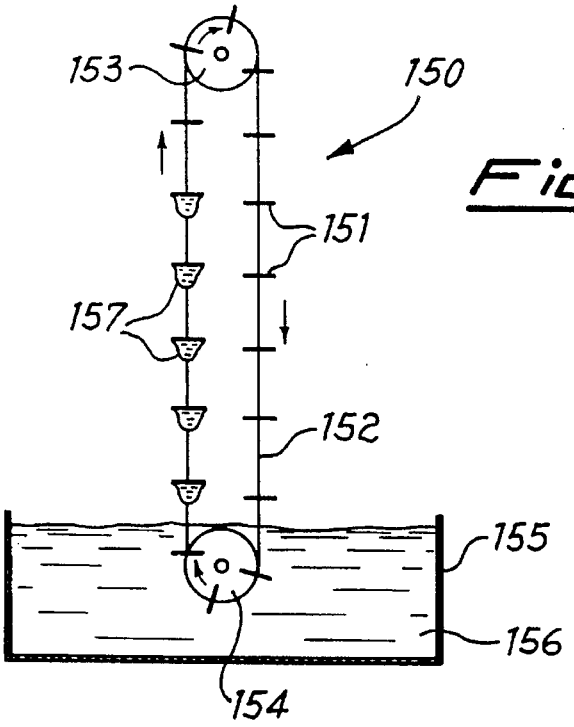
Fig. 28
Fig. 29 A
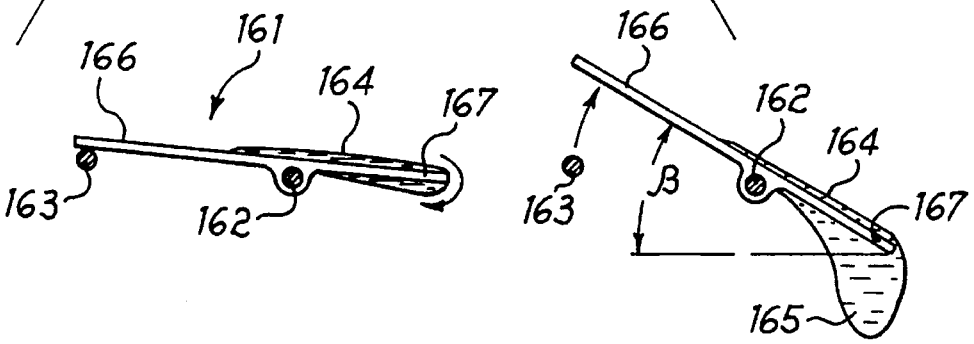
Fig. 29 B
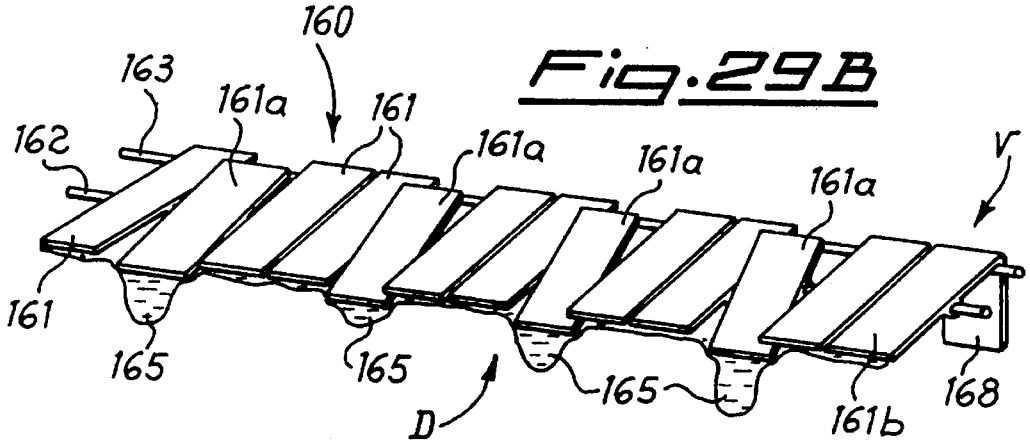

METHOD AND SYSTEM OF GENERATING A VISUAL PULSATION EFFECT DISTRIBUTED ACROSS A VISUAL OR DISPLAY SURFACE

BACKGROUND

The development of visual effects which combine light and motion for catching the attention and pleasing the public has acquired a considerable interest in our 'visual' age.

In particular this is true when such effects can be combined successfully with the communication of a meaning, as in the case of symbols, brandnames, messages or images having an emotional appeal. The objective is to animate the perceived surface, otherwise being static. Motions like linear motions, rotation, harmonic oscillation as to their visual impact are subject to some fundamental limitation when applied to a vertical surface, such as e.g. a promotion panel in an exhibition or a decorated surface in public places, large portions (if not the whole) of the surface are moving in the same way in an exactly predetermined way unless complicated and expensive mechanisms are provided. If the motion is too slow the visual impact is limited, if it is too fast the clear perception of the visual content of the moving surface becomes difficult and the impact on the public can be negative.

More important, however, there is no apparent randomness. Apparent randomness combined in the right way with a predetermined motion pattern involving a multitude of visual elements is known to produce visual arrangements which possess a high emotional impact on the observer; it is not coincidental that many contemporary art works are based on apparent randomness. One of the high visual impact motion patterns is pulsation distributed over a surface, i.e. the combination of several elements, located at different positions on the visual surface, each element having a binary visual condition: on-off.

The perception of a visual surface, combining symbols, words and pulsation is a common experience for a car driver approaching a highway work zone where pulsation is provided by arrays of flashing alert lights. Due to a law of motion perception known as 'constancy of size' the image perceived by the driver includes static elements (symbols, words) and, clearly distinct from them, pulsating elements which considerably enhance the visual impact of the scene without negatively affecting the understanding of the portion of the scene perceived as static. Whatever surface-pulsation effect is desired, including possibly apparent randomness, it can obviously be obtained by means of electronic and opto-electronic technology or just by light sources distributed over the visual surface and governed by a control unit.

These common techniques represent prior art in the general field of the present invention and include large electronic boards with thousands of light emitting diodes fed by optic fibers and controlled by a computer, advertising signs based on series of arrays of neon tubes etc.

These systems all have the following characteristics:

They are primarily designed to communicate information rather than also to please the viewer. The viewer is not prompted to get closer because the individual pulsating elements (a light source which goes on and off) has no attractiveness of its own by itself. The aesthetic or decorative value which is important for pleasing and attracting the viewer and for the system to be accepted in a stylish setting, is limited or non-existent.

The system itself does not increase or reinforce the impact of the image it communicates as it is perceived by the public or the viewer substantially merely as a technical device.

Visual quality is expensive; if apparent randomness is desired, appropriate computer hardware and software is needed.

As the present invention includes the use of one or more liquids, an example for them being water, decorative objects using flowing liquids such as fountains or other structures have also to be considered as background of the invention: in fact one of the primary uses for the present invention is decoration.

Fountains and other objects have been made employing different materials such as minerals, metals, glass, plastics, such as acrylics etc., and some of them include structures from which drops of liquid can be generated.

This prior art, which is generally based more on architectural and sculptural rather than physical or scientific skills, has not offered a clean and precisely controlled pulsation effect such as the one sought and achieved by the present invention. E.g. Alain Cocoub (French patent 2 617 742) teaches a decorative structure including water droplets, such water droplets being directly generated from nozzles connected with a pipe conveying the liquid under pressure. This system is designed for obtaining a rain of droplets or tiny water jets, such rain being generated at a series of fixed points (the nozzles) and such rain representing the visual attractiveness of this system.

This known system thus does not rely, as does the present invention, on the concept of producing the visual impact in the area where the drops are formed by means of the pulsation effect as taught by the present invention, wherein such pulsation effect is obtained exclusively by forming a film of liquid, by limiting the rate of liquid received by the film, and by defining the physical and surface characteristics of the material wetted by the film as a function of the physical characteristics of the liquid including surface tension.

Therefore, the main objects to be achieved by the invention can be summarized as follows:

A method and system capable of animating a visual surface requiring very little, if any, space, and requiring no expensive technical components.

A method and system which can combine, if desired, the clear perception of a visual surface having a meaning or an information content of its own to be communicated or an aesthetic merit of its own, with a pulsation effect distributed across the visual surface, such pulsation effect being perceived as if possessing randomness properties.

A method and system where the pulsation itself and the individual pulsating elements provide an aesthetic/decorative appeal by themselves, inviting the viewer to get closer for observing and looking on from close-by.

A method and system which are in tune with the present age of communication of 'natural' values, as one of the considered liquids is water.

SUMMARY OF THE INVENTION

In accordance with the basic concept the present invention provides a method and system for achieving a specific pattern of flow of a liquid designed for visual perception including the formation-separation of hanging drops of a specific shape and size from a film of the liquid, such flow pattern being the result of selected physical characteristics of one or more solid elements supporting the flow, in combination with the flow rate and the physical properties of the liquid itself.

The formation of a film of liquid wetting the lower portion of the supporting element is an essential condition for obtaining the desired randomness of events of formation-separation of the hanging drops.

Events of formation-separation of hanging drops can also involve a structure comprising a series of supporting elements, possibly but not necessarily structured and positioned in a way that each supporting element receives the falling drops from the adjacent supporting element above and generates drops to be received by the adjacent supporting element below.

The formation-separation process is fast enough to be perceived as the 'on' condition of the single pulsation event at any specific site or spatial position whereas the absence of this process is perceived as an 'off' condition for any such specific site or spatial position. The interrelated time sequency/spatial pattern of 'on' conditions on a portion of a total visual surface, such portion being of the order of magnitude of approximately the ten-fold of the drops size, in combination with the simultaneity or coincidence in time of many 'on' conditions (hereinforth called 'on' events) on the total visual surface produces the perception of a pulsating visual surface with randomness characteristics.

The method provides formation-separation events with a percentage of regularly shaped hanging-separating drops sufficiently high to maintain a high aesthetic quality of the pulsation when observed close-by.

The perception of the formation-separation phase of the hanging drop is sufficient for the clear perception of an 'on' event, and consequently the subsequent motion of the separated drop in the air need not necessarily be perceived, if desired, for achieving the desired over-all pulsating impression. At the same time it is not necessary, for obtaining the desired over-all effect, to completely follow the motion of the liquid from the upper portion to the lower portion of the supporting element.

Consequently, if desired it is possible to considerably reduce the percentage of the visual surface engaged by the pulsation, devoting a major portion of the surface area to a symbol, a message, a picture etc.

As the hanging drops are arranged on an array of parallel lines along the visual surface, this will allow the clear perception of the visual surface itself AND of the pulsation.

Alternatively, if desired, the lower portions of the supporting elements where the hanging drops are formed and the space between adjacent supporting elements can be made visible to the observer and the appeal of the visual surface will be primarily the result of the pulsation.

Considered from the optical point of view both the shape of the hanging drops and the shape of a drop in the process of separating from the supporting element before being fully separated are such that the drops are not only clearly perceived under a variety of illumination conditions but they will considerably increase the visual impact of the system.

While the novel method and system of the present invention allow to keep the visual surface very thin in the direction of the dimension perpendicular to the surface itself even when using a common liquid like water, extremely thin surfaces can be achieved when using liquids having a lower surface tension. As one of the contemplated liquids is water, the method allows to exploit the decorative value, emotional power and cultural meanings of this liquid.

SHORT DESCRIPTION OF THE DRAWING

The general concept underlying the invention and various preferred embodiments thereof will now be described in greater detail, having reference to the drawing wherein:

FIG. 1 (with parts A through D) illustrates in sectional front view, various types of formation of hanging drops other than those contemplated within the scope of the invention, whereby to distinguish the present invention FIG. 2 shows in sectional front view part of a supporting element, liquid film suspending therefrom and hanging drop evolving from said liquid film, in accordance with the principles of the present invention FIG. 3 (with partial FIGS. 3A through 3H) in an elemental front view similar to FIG. 2 illustrates the change of profile of a portion of the suspending liquid film during formation and subsequent separation of a drop hanging therefrom, according to the principles of the invention FIG. 4 shows in sectional side view (at right angles to the longitudinal primary dimension of a supporting element) an element of a system embodying the invention, illustrating various important parameters determining the desired operation FIG. 5 illustrates in schematic top view a supporting element in accordance with an embodiment of the invention permitting generation/separation of drops to occur at sites distributed along two dimensions of said supporting element FIG. 6 illustrates in schematic front view a portion of a system in an embodiment of the invention employing two different liquids FIG. 7 shows in schematic view an embodiment of the invention wherein the upper portion of the supporting element comprises a container for the liquid to form said suspending film of liquid at the lower surface portion of the element FIG. 8 illustrates in sectional side view (at right angles to the longitudinal primary dimension of the supporting element) an embodiment wherein the supporting element comprises two mutually inclined sections or portions, thus forming a liquid container on the upper side of the supporting element FIG. 9 illustrates in schematic front view a system embodying the invention comprising a plurality of supporting elements arranged in a vertical array FIG. 10 illustrates in front view a visual display embodying the invention, combining within the display surface the display of a logo element in superposition with the random pulsation effect of forming and separation of liquid drops FIG. 11 is a partial view of the visual display system of FIG. 10 in sectional side view FIG. 12 shows in partial sectional side view a system of the invention comprising a plurality of support elements arranged in a vertical array, illustrating various parameters, including vertical distance between individual supporting elements FIGS. 13 and 14 illustrate, in schematic front view, the variation of drop profiles during successive stages of drop formation and evolvement, with FIG. 13 showing regular shape forms desired for the method and system of the invention, while FIG. 14 shows undesired profile shapes avoided or minimized by the method of the invention FIGS. 15 through 17 are graphic diagrams illustrating various patterns of the spatial and time sequence of randomlike drop formation/separation ('on-events')

FIG. 18 is a diagram showing the dependence of duration of 'on-events' (randomlike drop formation/separation) on liquid feed rate FIG. 19 illustrates in sectional side view an embodiment similar to FIGS. 11 or 12 comprising a plurality of supporting elements arranged one above the other in a vertical array, wherein, however, the front edges of the supporting elements define a plane (display surface) inclined relative to the vertical FIG. 20 shows in sectional side view an embodiment comprising a vertical stack of supporting elements having a curved cross-section in side view, whereby drops will form and separate at two distal front edges of each supporting element FIG. 21 shows in schematic side view a specific embodiment wherein the support elements are shaped each to include a front portion forming a physical constituent element of the display surface, integral with the liquid film supporting part of each element FIG. 22 illustrates, in perspective view, a supporting element having a nonlinear front edge FIG. 23 shows in partial sectional front view a portion of a supporting element in an embodiment wherein the supporting element has associated therewith a liquid feed pipe as a unitary structure FIG. 24 in a similar view as FIG. 23 a similar embodiment wherein the pipe associated with the supporting element serves as a light-guide for light-piping light to the active drop formation area of the supporting element, or for combining the light-piping and liquid-feed line function, whereby to optically enhance the visual impact of the hanging/separating drop FIG. 25 illustrates in sectional partial side view an embodiment comprising a plurality of supporting elements arranged in vertical groups staggered side-wise, the individual support elements being slightly inclined whereby to induce perceptible physical movement of the forming/evolving drop from the site of initial formation to the site of final separation FIG. 26 illustrates in schematic view the combination of a random-like liquid drop formation device of the present invention with a lamp arrangement, for room-illumination purposes, as an important field of application of the invention FIG. 27 illustrates in schematic front view an embodiment of the present invention as a self-contained device comprising liquid supply containers and a plurality of supporting elements served by said supply containers, said device being designed for being successively turned upside-down for a cycle of operation FIG. 28 illustrates, in schematic side view, an embodiment of the invention wherein mechanical motion is imparted to the supporting elements, in a manner that a vertical motion of the supporting elements is superposed over the random-like formation/separation of drops between the moving supporting elements FIGS. 29A an 29B illustrate still another embodiment adding a feature of mechanical movement of the supporting element to the overall random pulsation effect achieved by the invention, with FIG. 29A showing a single supporting element component tiltably arranged for a limited tilting movement under the influence of the drop, formation process, while FIG. 29B illustrating a horizontal array consisting of individually tiltable support element components of the type shown in FIG. 29A.

DETAILED DESCRIPTION

Figure 4:
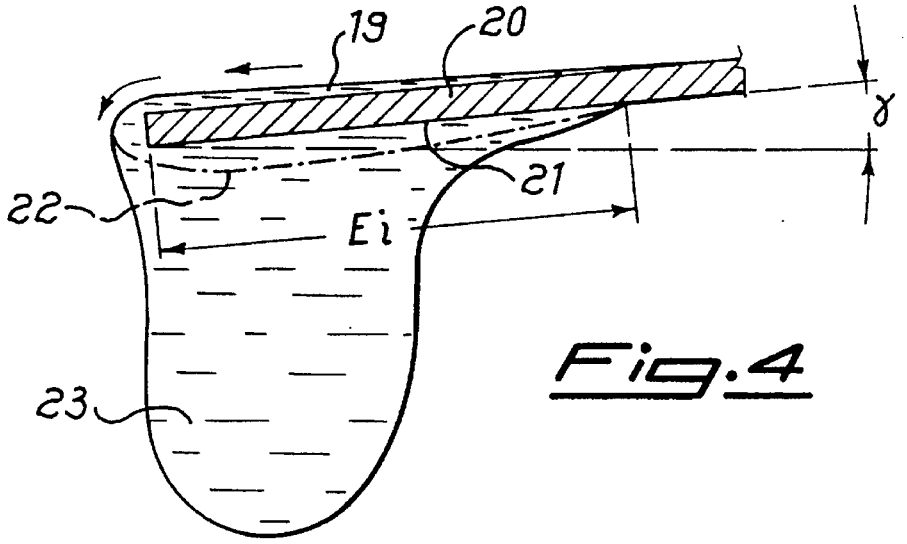

The basic single event generating the visual pulsation effect in the system of the invention is the formation and subsequent separation of a hanging drop from a film of liquid wetting the lower portion of a supporting element, the profile of the drop evolving during the formation-separation process in a regular way at increased speed.

In order to clearly distinguish this event from continuous occurrings which also involve hanging drops of liquid separating from a supporting element but are not included in the scope of the invention, FIG. 1 shows a certain number of those common occurrings outside the scope of the invention.

FIG. 1 at A shows a hanging, drop 11 generated by a nozzle: the profile of the drop in a phase when starting to be visible has already reached almost its final curvature. The lower surface of the supporting element 10 is not wetted.

FIG. 1 at B shows a hanging drop generated at an opening. The contact angle θ formed by the drop with surface 10 is clearly higher than zero degrees because the surface energy of surface 10 is low as compared with the surface energy of the liquid and with the interfacial energy between surface 10 and the liquid. Consequently the opening does not initially generate a film of liquid wetting the surface 10 but directly generates a drop 12 undergoing only a limited change of profile.

FIG. 1 at C shows a hanging drop 13 generated by an opening but displaced from and connected to the liquid flowing through the opening by a thread of liquid, such thread being characterized by a very low radius of curvature as compared with the drop. The situation is similar to 1B.

FIG. 1 at D shows a liquid profile 14 separating from surface 10 generated by the 'melting together' of two adjacent hanging drops, such fusion being caused by a high flow rate of the liquid reaching the lower portion or surface 10 of the supporting element 15. Said feed flow-rate of liquid flowing from the upper surface around the edge 15*a* of the supporting element is too high for the controlled formation-separation process contemplated by the present invention to occur.

FIG. 2 shows a front view of the profile of a hanging drop 17 before separation as taught by the invention: the profile of the hanging drop 17 is the result of the modification of the profile of a film 16 wetting the lower surface 10 of a supporting element 15. The angle of contact θ of the drop with the surface 10 is zero degrees.

FIG. 3 shows in front view a sequence A–H of profile modification of the film of liquid during formation-separation of a hanging drop 17, until the original film profile is restored. The visual attractiveness results from this process of changing form of the outer drop profile, in combination with changing forms 18*a*–18*f* inside the drop profile, which represent distorted optical images of the background of the hanging drop, due to the optical lens effect of the drop shapes during formation thereof.

As the width D (cf. at E in FIG. 3) of the drop is very small (approximately 4.60–5.40 mm in the case of water, with lower values for liquids having a lower surface tension) the radii of curvature of the convex surfaces of the drop are very small and consequently the optical field of object is large. Depending on the inclination of the cross-section of the surface 10 where the drop is forming, background shapes or structures lying in the same common horizontal plane with drop 17 are effectively included in the optical image shapes 18 when included within a range of lateral angular distances which do not exceed 40–55 degrees. Beyond this limit only shapes or structures with optical contrast higher than 100 or even 1000 will be visible when viewed close-by (i.e. from a viewing distance of 0.50–1.00 meter). For the sequence A–H (FIG. 3) to evolve it takes a time varying from 0.2 to 0.3 seconds in the case of water, and this sequence represents one 'on' event of the pulsation in the system of the present invention. The duration of the 'on' event and the average size of the drops allow a clear perception of pulsation also from viewing distances of 10–20 meters, provided there are suitable photometric conditions.

The formation of the film of liquid on the lower portion of the supporting element depends on the kinetic energy of the liquid when reaching the lower portion, on the wettability property of the surface material of the lower portion by the liquid employed, and on the profile and inclination of the cross-section profile of said supporting surface.

FIG. 4 (which is a side view at right angles to FIG. 2,3) shows, as an example, an amount of liquid 19 flowing along and from the upper surface of the supporting element 20 and forming a film profile 22 when initially reaching the lower portion 21 of the supporting element; the film subsequently generates a hanging-separating drop 23 in accordance with the principles of the present invention.

The method and system of the invention do not generally require a (lower) surface 21 having a typical contact angle of zero degrees (perfect wetting) with a drop of liquid (Young model), in order to ensure formation of the film of liquid. The minimum critical surface tension (CST) value of surface 21 depends on the surface tension of the liquid employed.

The critical surface tension (CST) of a solid surface is defined as the lowest surface tension (in relation to a specific liquid wetting said solid surface) said liquid may have while still exhibiting a contact angle greater than zero degrees on that solid surface.

In the case of water or other liquids having a similar surface tension value of more than 60 mN/m (millinewton/meters) (distilled water: 72), support materials with CST value as low as 28 millinewton/meters can be used including polymers with typically low surface energy values between 30 and 50 $mJ/m^2$.

Assuming a flow rate of liquid passed to the lower portion of less than 200 ml/min for every 100 mm of primary (=longitudinal) dimension of the lower portion of the support element 20 (i.e. perpendicular to the plane of FIG. 4) the formation of a film throughout this length is assisted by increasing the value of the angle gamma of inclination of the support element 20 (not beyond 40°).

Thus, polar polymers can form smooth surfaces 21 ensuring formation of the film under the conditions required by the invention provided the liquid is polar and provided there is a sufficient time of exposure to the liquid, as the interfacial energy between the liquid and the surface 21 will cause reorientation of the molecules of the polymer at the interface. Non-polar polymers with a low value of free surface energy can also be used provided the contact-angle with the liquid is reduced by means of suitable methods, known in the art.

The formation of a film can be obtained on surfaces possessing a CST (critical surface tension) of less than 28 mN/m by using liquids having a lower surface tension value which also reduces the size of the hanging-separating drops. Formation of the film and of the desired pulsation effect of the present invention has been obtained with liquids having a surface tension value of 40–60 mN/m by using materials with a typical CST value as low as 25 mN/m (measured on a smooth surface), by further reducing the surface tension of the liquid, even as low as 20 mN/m. In both cases the amount or value of feed flow rate has not been increased beyond 200 ml/min for every 100 mm length of the primary dimension of the lower portion of the support element.

The length Ei, i.e. the length of liquid film profile in the direction substantially perpendicular to the primary dimension, i.e. in the direction of the plane of FIG. 4 must have a minimum value depending on the surface tension of the liquid used in order to allow formation and separation of the desired regularly shaped drops in the desired random-like manner. The corresponding minimum values for Ei are 4.5 mm for a liquid with a surface tension of more than 60 mN/m (such as water), 3.5 mm for surface tension values of 40–60 mN/m and 2.0 mm for S.T. values lower than 40 mN/m.

A specific case exists if angle gamma is zero degrees but Ei is so small that only one line of hanging-separating drops is formed along the length of the primary direction of the supporting element. In this case the drop profile shown in FIG. 2 is the same for all vertical cross-sections and consequently distorted images of background shapes or structures in the early stages of hanging drop formation (FIG. 3, 18*a*, 18*b*) can only be obtained from background shapes positioned vertically displaced above the hanging drop. The formation of only one line of hanging/separating drops in this case, as in previously considered cases with gamma larger than zero degrees, provides the same limiting value for the flow rate, i.e. less than 200 ml/min for every 100 mm of length along the primary dimension of the lower portion.

On the other hand the maximum value for Ei (in case only one line of drops along the primary dimension of the supporting element is desired) depends on the horizontal diameter of the hanging drop measured at the circumference of contact with the film of liquid which in turn depends on the value of surface tension of the liquid.

In accordance with the teachings of the invention there is an upper limit for Ei of 20 mm for liquids with surface tension above 60 mN/m; of 15 mm for surface tensions between 40–60 mN/m; of 9 mm for surface tensions of less than 40 mN/m.

Above these maximum values for Ei, for the same forementioned corresponding ranges of the surface tension value of the liquid, if gamma=zero degrees, the limit value for the flow rate has to be expressed as a function of the surface of the lower portion, because randomness of pulsation produced by one such supporting element becomes bi-dimensional.

Figure 5:
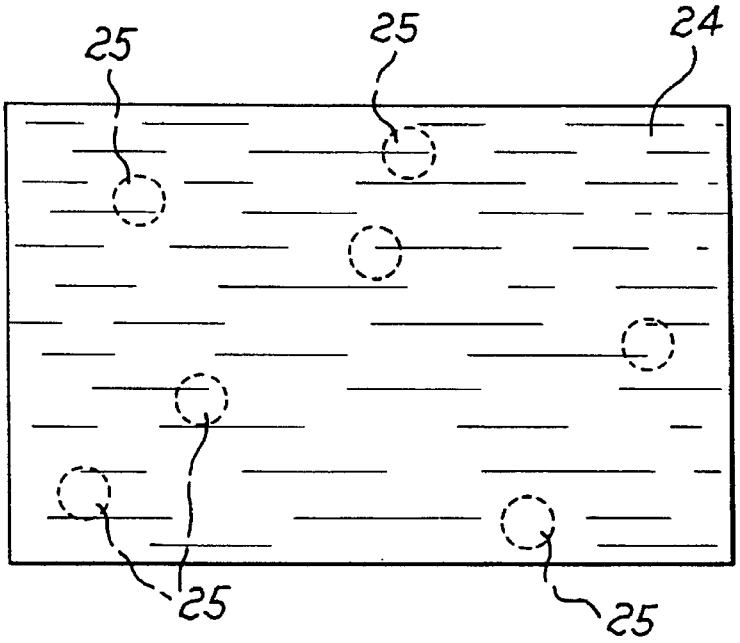

FIG. 5 shows a top view for an example of this case: 24 is the film of liquid wetting the lower portion from which hanging drops 25 are forming and separating at not-predetermined spatial points or sites, and in not-predetermined time sequence. In this case the contribution of the kinetic energy of the liquid passed to and received by the lower portion of the support element to the formation of the film of liquid is limited except for the areas close to the edges of the lower portion and consequently, the larger the surface of the lower portion the more important becomes the property of the surface of the lower portion to be easily wetted by the liquid.

By using liquids and constituent materials of the surface having surface tension and corresponding CST limit values as previously described, the maximum admissible surface of the lower portion providing the desired bi-dimensional pulsation will depend on the specific combination of the respective selected liquid and selected surface interfacial properties; e.g. the interfacial energy can be reduced, if needed, by surface modification techniques known per se in the art. As an example, water and a low surface energy material such as a polymer will require a modification process of the wetting property of the surface starting from surface sizes of a few square centimeters.

For this case the claimed invention determines an upper limit value of feed flow rate of 1300 ml/min for every 100 $cm^2$. Beyond this limit of flow rate continuous threads of liquid tend to appear on a regular basis and the average duration of 'on' events grows strongly, negatively affecting the visual quality of the pulsation. Generally, a supporting element comprising a porous structure such as e.g. a cellular structure, retaining the liquid by capillarity can be advantageous for the wetting property of the liquid towards the supporting element and may also reduce the time of formation of the film of liquid.

The desired visual pulsation effect can be obtained also if the liquid forming the hanging-separating drops is a first liquid and the one or more supporting elements (together with said first liquid thereon) are submerged in a second liquid, having a lower density than the first liquid, the two liquids being mutually insoluble.

Figure 6:
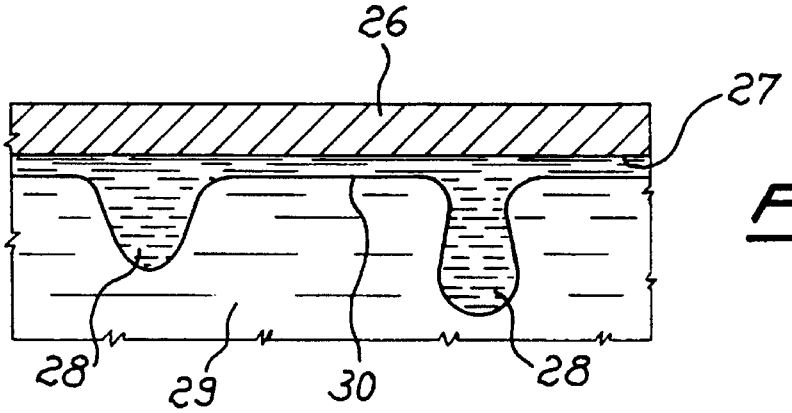

As an example of such a two-liquids-system, FIG. 6 shows two hanging-separating drops 28 of a first liquid wetting the surface 27 of the lower portion of the supporting element 26 and a second liquid 29.

The required formation of a film 30 of the first liquid (FIG. 6) is the result of the capacity of the first liquid to displace the second liquid from the surface 27. Such displacement is always obtained, independently of the feed flowrate value of the first liquid and the geometry of the supporting element, if and when the interfacial energy between the two liquids is higher than the difference between the interfacial energy of surface 27 towards the first liquid and interfacial energy of surface 27 towards the second liquid.

Many different combinations of liquids can be considered and for a given first liquid, the size of the hanging-separating drop depends on the interfacial energy with the second liquid, which consequently determines limiting values for Ei as previously defined.

The influence of angle gamma (FIG. 4) on the regularity of the profile of the hanging-separating drop, as shown in FIG. 2 and 3, depends also on the viscosity ratio of the two liquids.

If desired, water can be selected as the first liquid and the formation-separation of hanging drops is clearly visible through the second liquid even for differences of refraction index as low as 0.04–0.05.

A preferred one of the selected combinations might be water and a hydrocarbon possessing a low value of surface energy such as hexane, with supporting elements made of glass which has a surface energy value considerably higher than polymers.

Figure 7:
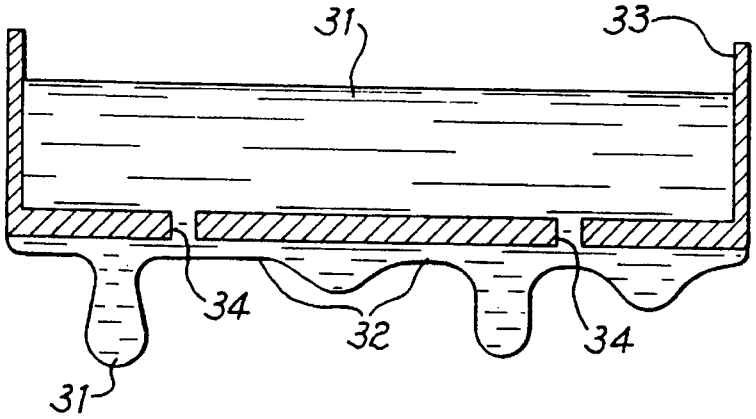

FIG. 7 illustrates an embodiment wherein the liquid 31 forming the drops (henceforth referred to as: 'the liquid') can be provided, for forming the downwardly facing film 32 on the lower portion of the supporting element, by an upper portion of the element, facing upwards and shaped as a container 33 filled with the liquid 31 and through openings 34 allowing the transfer or feed flow of the liquid 31.

Figure 8:
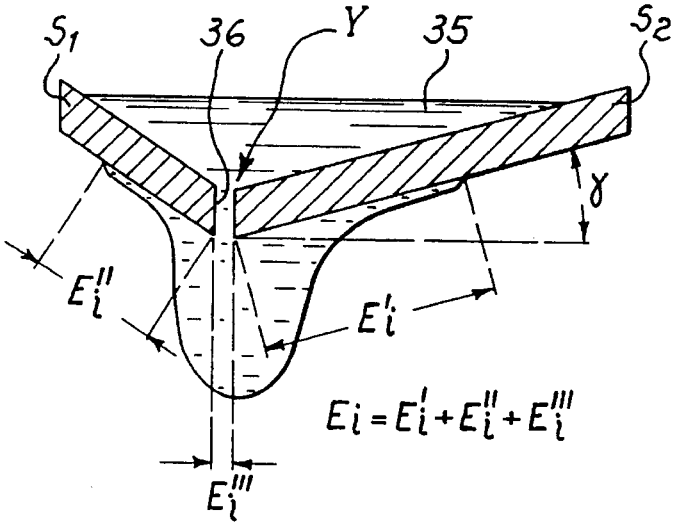

FIG. 8 shows in cross-sectional side view an embodiment having an upper portion of the support element shaped as a container, in the case of a supporting element extending along a primary dimension perpendicular to the plane of the figure. In the specific embodiment shown in FIG. 8 the longitudinally extending support element comprises two relatively inclined sections $S_1$, $S_2$ joining each other along a longitudinally extending line of juncture Y defining the lowermost part of the support element profile. Openings 36 are provided preferably at the lowest point of the lower surface of the support element, i.e. at the intersection of the two opposite inclined sections of the support element, through which the liquid 35 can be transferred to the lower portion. Said openings 36 may be slits, small circular holes or openings of other shapes or configurations.

In accordance with other embodiments the transfer or feed flow of the liquid for forming the wetting film at the lower portion of the supporting element may be provided by the liquid flowing from the upper surface around one or more edges of the supporting element, as shown in FIG. 4, in order to form the film profile 22 from which the drops will form and separate; if desired, such a supporting element may also include small openings so that liquid can be transferred from the upper to the lower portion of the support elements not only at and around the edges, but also through the body of the supporting element.

The supporting elements can be arranged one above the other in the form of a vertical stack wherein each supporting element receives drops from the next adjacent supporting element above and provides drops to the next adjacent supporting element below, generating a visual pulsation effect across smaller or larger visual surfaces depending on the number, size and spacing of the supporting elements.

Figure 9:
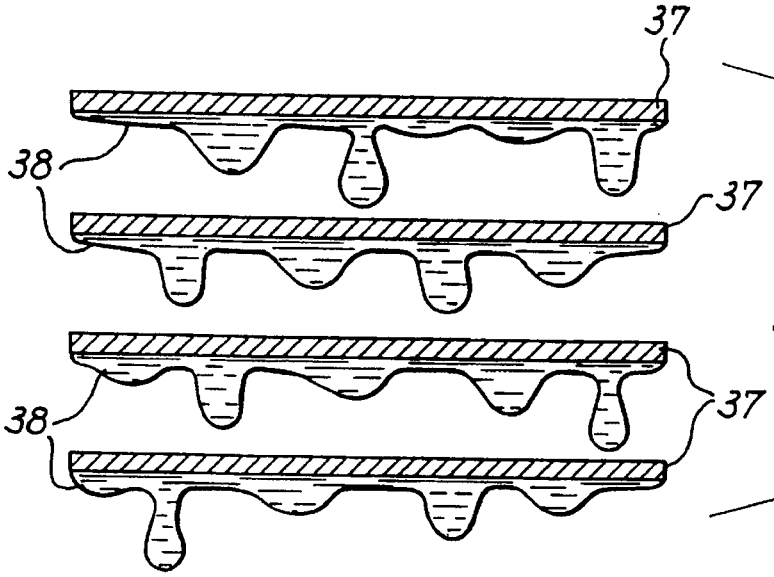

FIG. 9 illustrates, in a front view, such an arrangement comprising a series of supporting elements 37, with the continuous change or modification of the liquid profile 38 generating the visual pulsation effect characteristic of the present invention.

Figure 10:
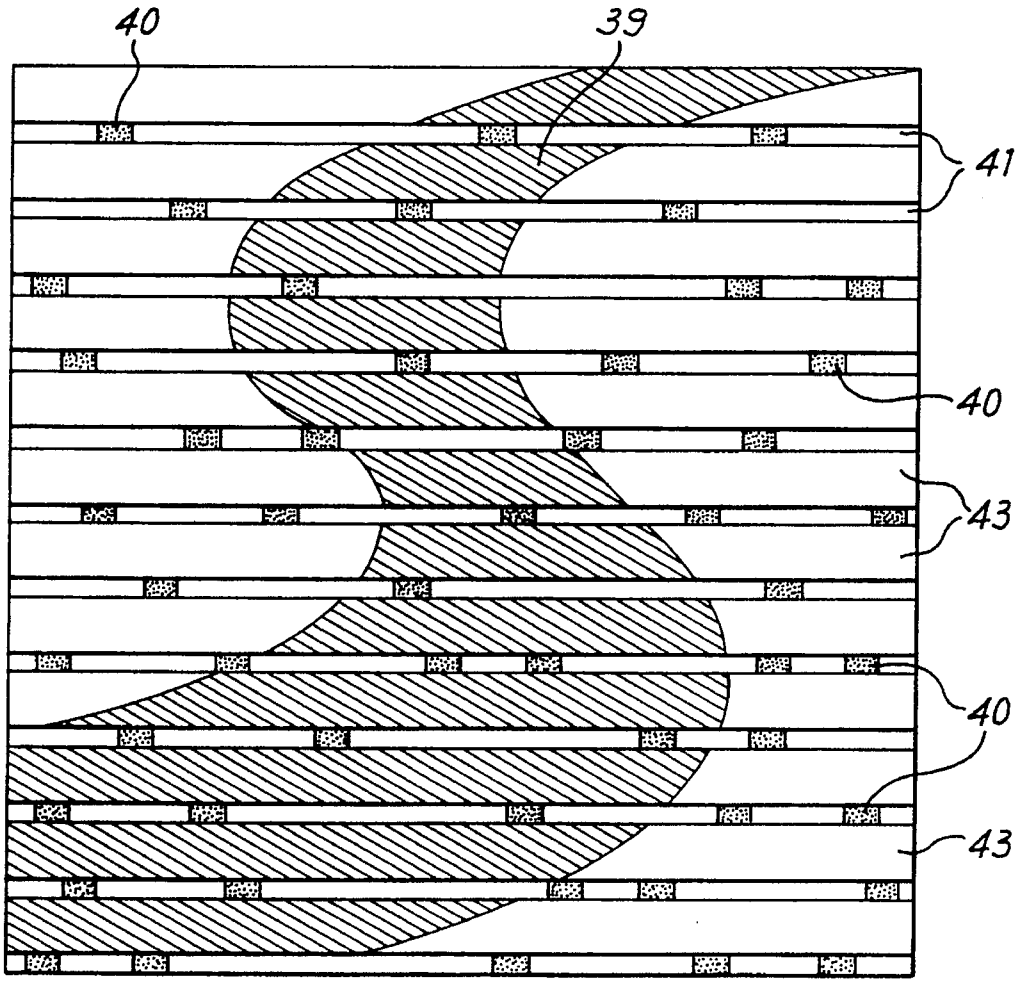

FIG. 10 shows in front view a visual surface 43 displaying, as an example, the logo of an 'S' 39 in front of a vertical arrangement of liquid film supporting elements of the general type as shown in FIG. 9, the formation and separation of liquid drops between the supporting elements being viewable through horizontal openings or slots 41 in the visual surface with the 'S' logo thereon. The latter thus is animated by the pulsation effect of the present invention, perceived by the viewer as a sequence of 'on'-'off' events with apparent randomness characteristics, each 'on'-'off' event being generated by the separation of a single hanging drop ('on', at 40) and return of the liquid film at the respective site to its original condition ('off'), such pulsation being visible by means of the openings 41.

Figure 11:
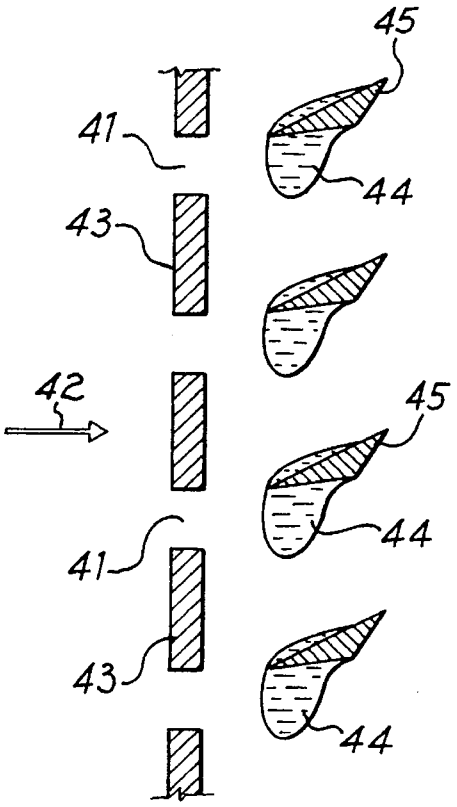

FIG. 11 shows in partial side view the embodiment of FIG. 10. The viewer, looking from a position at the left in FIG. 10 and viewing in the direction indicated by arrow 42 will perceive the surface 43 including the stylized 'S' animated from behind by the background of separating drops 44 generated by the supporting elements 45, through the openings 41.

FIG. 12 shows in side view details of preferred embodiments of the invention, described hereinafter assuming that the liquid is water and the surrounding medium is air.

In the following discussion of FIG. 12 explaining the influence of the main parameters determining the random-like formation/separation of suspending drops reference is also made to FIGS. 13 and 14 illustrating the desired regular drop profile evolvement preferred for the purposes of the present invention (FIG. 13) versus undesired irregular drop profile (FIG. 14), respectively. FIGS. 13 and 14 are schematic front views of a supporting element 52 with liquid film 50 suspending from the lower side thereof, at the site where a drop 53 is forming and evolving. The desired modification of the liquid profile viewed by the observer placed in front of the visual surface when the drop is forming and before completion and separation from the supporting element is shown in FIG. 13 and can only be obtained under certain determined conditions as will be set out hereinafter in connection with the discussion of FIG. 12. In FIG. 13, the liquid profile at the site of drop formation and evolvement through successive stages in time are indicated by the shapes 53*a* through 53*e* corresponding to constant time intervals. As will be noted the desired drop profile shapes 53*a* through 53*e* are substantially symmetrical with respect to a (vertical) line through the center 53' of the drop formation site. Instead, FIG. 14 illustrates undesirable irregular drop shapes represented by irregular profile shape lines 54, 55, 56 corresponding in time to the stage 53*c* in the regular drop shape sequence of FIG. 13. A minimum percentage of irregularly shaped drops which negatively affect the visual quality of the perceived visual surface of the present invention will generally be present, but the percentage of such undesirable irregular drop formations can and should be reduced by suitably controlling the parameters determining drop formation as will be set out in the following discussion of FIG. 12.

Provided the distance or space p (FIG. 12) between the lower portion of each supporting element wetted by the liquid and the upper portion of the adjacent element below has an average minimum value, measured along the length of the supporting element (i.e. the 'primary dimension' perpendicular to the plane of the drawing, in the case of longitudinal elements), of not less than 7.0 mm, such interspace between vertically adjacent supporting elements will allow, for determined overall characteristics, the specific hanging/separating drops of the present invention to form and evolve into the fully developed shape profiles 53*e* (FIG. 13) before contacting the film of liquid 47 (FIG. 12) on the upper surface of the next adjacent element below.

In the arrangement of FIG. 12, the abrupt formation of a catenoid between adjacent supporting elements due to contact of a forming drop, prior to separation thereof, with the film of liquid 47 on the upper side of the adjacent element below, the catenoid thus formed between the two adjacent supporting elements would itself produce a smaller hanging drop and a 'reverse' drop on the adjacent supporting element below. The weight of the smaller hanging drop would be too low to counterbalance the surface tension and the original liquid profile (i.e. before formation of the hanging drop) would be restored. The 'reverse' drop would be absorbed even faster on the upper portion of the adjacent supporting element below due to the sum of surface tension and gravity.

A distance p (as defined) of less than 7.0 mm would negatively affect the pulsation effect due to the formation of liquid volumes between supporting elements, such volumes having a length along the supporting elements which may be extremely variable and an average duration which may be seconds or even minutes if the distance p were further reduced, depending also on the flow rate of liquid feeding the film and on the supporting element profile.

A distance p of more than 17.0–20.0 mm does not negatively affect the perception and impression of pulsation and is within the scope of the method; it should be noted, though, that the visual perception of a single drop during formation immediately before separation, and during separation from the supporting element, is primarily determined by object relative displacement rather than by angular displacement. Perception based on object relative displacement depends on the process of change or variation of form or shape which under the conditions and circumstances of the present invention is more pronounced while the drop is forming-separating, as compared with the subsequent phase, i.e. when the drop, once completely separated, moves down in the air as a sphere.

The upper portion 49 of the supporting element which receives drops from the adjacent element above and supports the film of liquid 47 forming therefrom on the upper surface must have a minimum critical surface tension value and a minimum profile length Es measured along the transversal cross-section. This in order to ensure (a) formation of the film of liquid 47 all along the longitudinal (or primary) length of the upper portion of the supporting element, and (b) to ensure that such film per length unit (i.e. length in the direction of the primary dimension of the supporting element, not along the cross-section) is sufficient to absorb the major part of the impact energy of the incoming drop by means of two wave impulses generated at the point of impact and travelling or propagating along two opposite directions from such point of impact, whereby to avoid direct transfer to the lower portion of the supporting element of a portion of liquid possessing a momentum high enough to produce formation and separation of irregularly shaped drops (see FIG. 14).

The minimum length Es depends on vertical distance between adjacent supporting elements, on the inclination of the upper portion, and on the wetting property of the same: Es should exceed 5.0 mm, preferably exceed 8.0 mm, also in case of an inclination angle of the upper portion versus the horizontal of less than 10–20 degrees, a distance p of approximately 10 mm and perfect wetting of the surface (contact-angle according to the Young-model: zero degrees).

The liquid flows from the upper portion or surface of the supporting element to its lower portion through an intermediate (vertical) edge portion 48, to form the film (50) at the lower surface. Film (50) is formed throughout most of the primary dimension of the lower portion. By controlling the flow rate so as to not exceed a value of 200 ml/min/100 mm of primary dimension of the supporting element, hanging drops are forming and separating from the film on the lower portion with a percentage of regularly shaped drops (FIG. 13) which can reach 80% provided the following conditions are met: (a) the angle (gamma) formed with the horizontal by the lower surface as averaged over the area where drops are forming and separating should not exceed 40 degrees, and (b) the crosssectional length of the lower film profile Ei (FIG. 12) taken at right angles with respect to the direction of primary extension of support element should not be less than 4.5 mm, measured in the area where one single drop is hanging.

Figure 15:
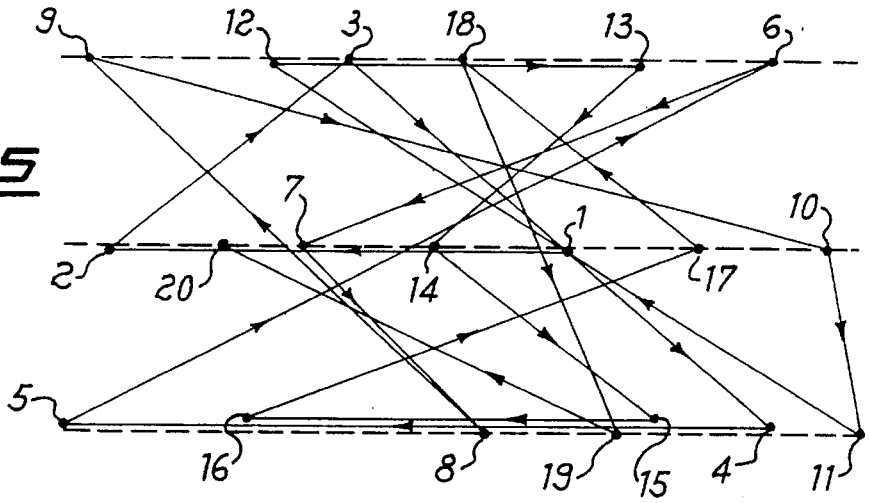

FIG. 15 shows an example of the spatial and time sequence of 20 'on' events within a visual surface portion including three adjacent supporting elements, spaced apart 15 mm from one another, such portion having a length of 75 mm. FIG. 15 illustrates the type of spatial and time distribution as desired for, and obtained by, the method of the invention.

Figure 16:
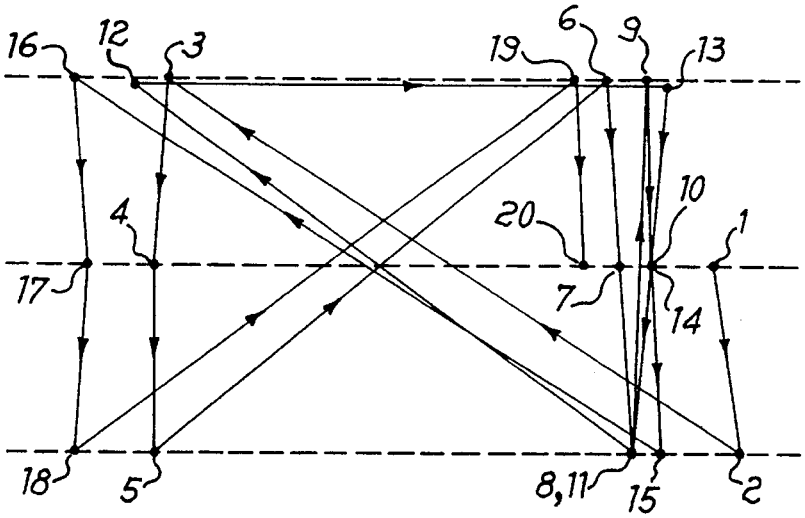

By comparison, FIG. 16 shows an example of the spatial and time sequence of 20 'on' events obtained by maintaining the same conditions as underlying and producing the sequence of FIG. 15, except that the angle of inclination gamma had a value of 45 degrees, i.e. outside the range of the invention. The type of spatial and time sequence of FIG. 15 effects a perception of pulsation with apparent randomness characteristics whereas the type of sequence of FIG. 16 produces the perception of two groups of points moving down, on the left and on the right. Furthermore, the 'on' event of the sequence of FIG. 16 is more difficult to perceive. In the FIG. 16 type of sequence a single 'on' event has a duration of 14/100 seconds as compared with a duration of 20/100–30/100 seconds in the case of the sequence of FIG. 15, in conformity with the teachings of the invention.

As perception tries instinctively to find an ordered pattern within disorder, not only sequences 3-4-5; 6-7-8 (cf. FIG. 16) etc. are not perceived as pulsation but as points moving down following a vertical line, but also sequences frequently occurring in the same or similar manner such as 6-8-9, 11-13-14 etc. are perceived in this way, i.e. giving the impression of predetermined patterns rather than a random-like sequence of events.

To a smaller extent, the perception of pulsation is also negatively affected by sequential events like 10-11 (FIG. 15) or 19-20 (FIG. 16). The average number for such 'double' events to occur in a group of sequences obtained under the conditions of sequency of FIG. 15 does not exceed 20%, a maximum of 5% being engaged in 'triple' events, such as, for example, 13-14-15 or 13-15-16. With angle gamma=45 degrees (FIG. 16) these percentages become 60% and 15%, respectively.

When varying the value of angle gamma within the range of the invention below 40 degrees, further reduction of gamma results in a reduction of the percentage of irregularly shaped drops (FIG. 14) by factors up to 60%, and there is an evident link between the occurrence of irregular drops and 'double-triple' events; in fact, 72% of 'on' events which are engaged in 'double' or 'triple' events, when proceeding either within outside the scope of the invention, have been found to be irregular in shape (FIG. 14) in one series of tests.

As mentioned, the condition requirements of the invention indicate also a minimum value for Ei of 4.5 mm. Embodiments of the invention designed in accordance with a criterion of minimum width should preferably (but not necessarily) have a width close to 9.0 mm.

Figure 17:
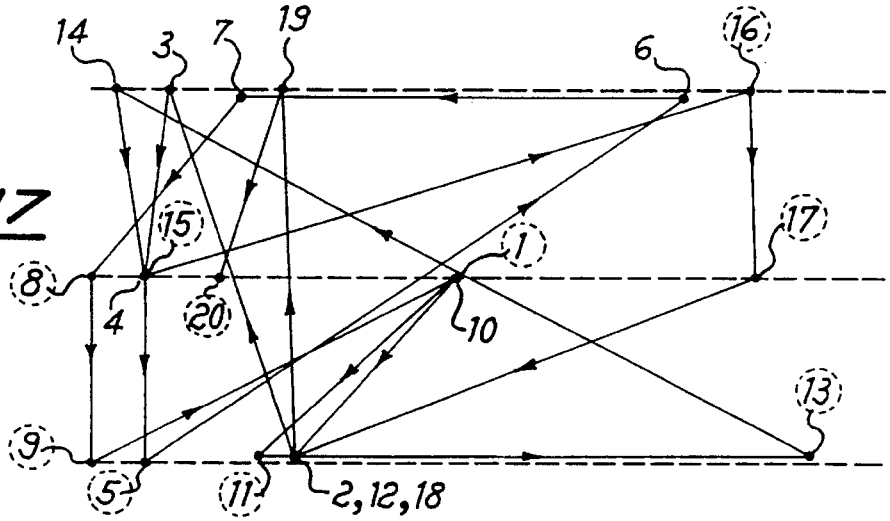

FIG. 17 shows an example of the spatial and time sequence which is obtained under the same conditions as the sequence of FIG. 15, except that the value of Ei is 4.0 mm. There is a relatively large number of irregularly shaped drops (circled numbers), and also a relatively large number of 'double' events as defined above.

Figure 18:
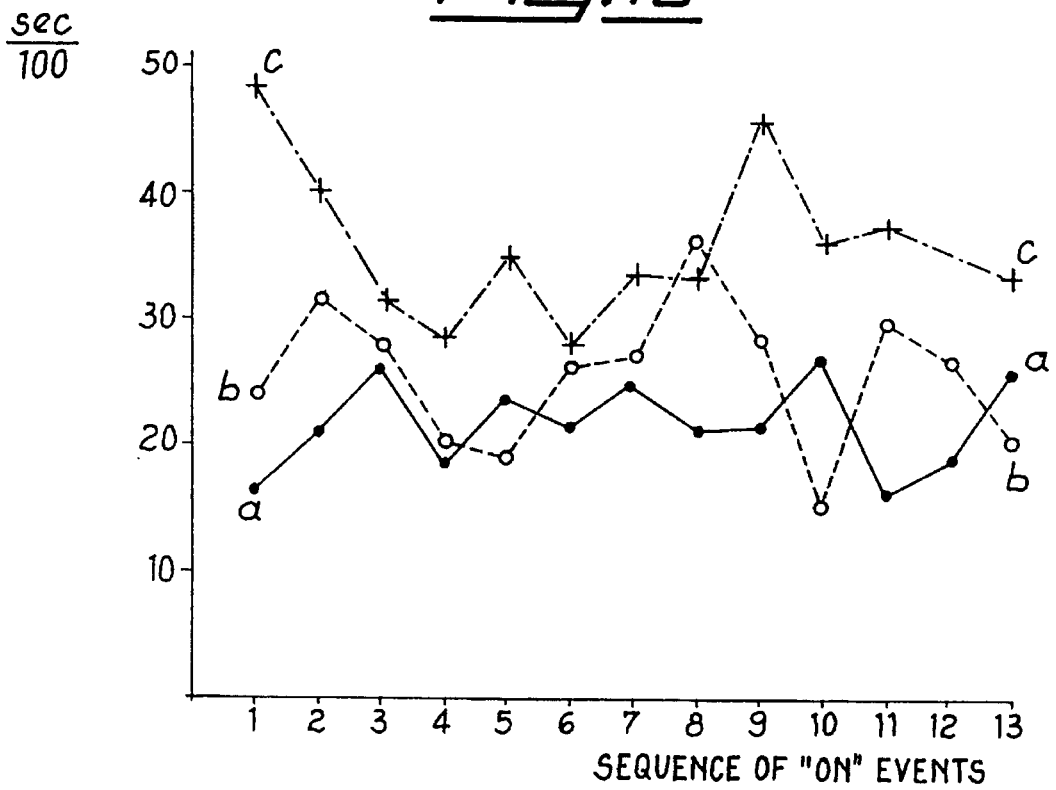

FIG. 18 illustrates the influence of (liquid feed) flow rate on the duration of 'on' events. With all other conditions being equal and in accordance with the invention, the flow rate value is varied from 60 ml/min for every 100 mm of length of supporting elements (full line (a)) to 160 ml/min (line (b)) and finally to 280 ml/min (line (c)). The plotted lines show the average duration of an 'on' event as part of several sequences of 13 'on' events each. The duration of the 'on' event grows and becomes more variable by increasing the flow rate.

At the same time the surface density of 'on' events at a given instant in time as perceived by the observer looking at the visual surface including the array of supporting elements, which depends also on the rate of starting 'on' events/surface unit per unit of time, is more than twice in the case of (c) compared to (a) and approximately 50% higher compared to (b) (FIG. 18).

An increase in duration of 'on' events reduces the perception of pulsation while a higher degree of variability of the duration of 'on' events reduces the visual quality of the pulsation. Furthermore, a higher surface density of 'on' events contributes to create a confusing image when viewed not close by: as a result the average separation of adjacent simultaneous 'on' events tends to be smaller than the normal power of resolution of the eyes, when viewing from approximately 4–6 meters from the visual surface under consideration, excepting the case of very carefully controlled illumination conditions. Consequently, in accordance with the teachings of the invention it is indicated to keep the flow rate below 200 ml/min for every 100 mm length of primary dimension of wetted lower portion of the supporting element. Considering the visual quality of the pulsation, preferred flow rates are in the range of 40–80 ml measured as previously indicated.

A sequence such as shown in FIG. 15 when obtained with a flow rate of 60 ml/min. per 100 mm of length of wetted lower portion may produce approximately between 6 and 7.5 'on' events/second over the same length. A further reduction of the flow rate, if kept within limits, does not cancel the pulsation perception with apparent random characteristics: hence, the visual character desired by the architect, artist or designer will ultimately eventually decide the precise flow rate value.

The pulsation density, as previously defined, cannot be considerably increased by increasing the flow rate without negatively affecting the apparent randomness characteristics and the regularity of drop shapes, the latter being even worse when observation happens to be from a close distance. In certain cases, like for instance when close-by visual quality is a primary consideration and consequently the size of the drops can be reduced, obtaining a higher pulsation density without affecting apparent random characteristics of pulsation and average regularity of drops shapes may be a matter of interest.

This can be obtained by reducing the surface tension value of the liquid, for instance by adding a surface tension modifier, readily commercially available.

In case of reduction of the surface tension value the size of the drops tends to be smaller and consequently the same flow rate will tend to increase the pulsation density as there is no sizable change in the average duration of an 'on' event.

By selecting liquid generating drops with a size g (FIG. 13) of 2.5–3.0 mm a pulsation density varying in the range between 12 and 16 'on' events/second/100 mm of length of wetted lower portion of the supporting element can be obtained.

Reducing the size of the drops will allow to reduce the distances p, Es, Ei, (FIG. 12) as previously defined but will not enable to modify the maximum admissible value of angle gamma (FIG. 12) as defined.

From the preceding explanations of the basic principles of the invention and the effects of the main controlling parameters, those skilled in the art will acknowledge that different shapes, sizes and materials may be considered for the supporting elements, the shapes of the cross-sections shown on FIG. 11 and 12 being just two examples among the many possible embodiments within the scope of the invention.

Figure 19:
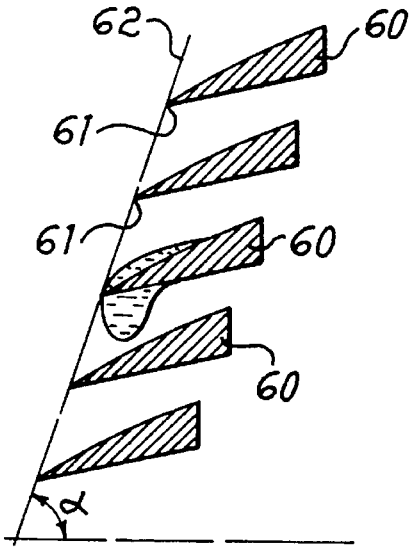

FIG. 19 shows in side view an embodiment comprising a series of supporting elements 60 arranged one above the other, the arrangement being, however, staggered such that the front edges 61 of the lower portions of the supporting elements are not comprised in the same vertical plane, but in a plane 62 forming an angle $\alpha$ smaller than 90° with the horizontal.

Figure 20:
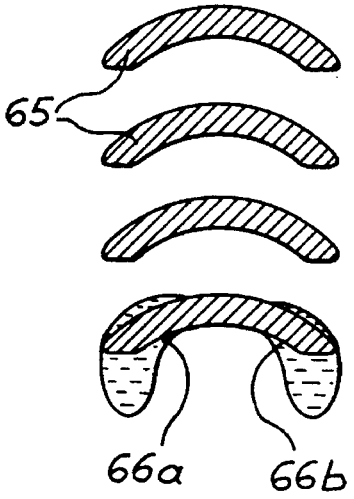

FIG. 20 shows in cross-sectioned side view a series of supporting elements 65 each element possessing two lower portions **66*a*,66*b*** generating drops.

FIG. 21 shows in side view a series of supporting elements 70 each comprising a decorated front surface portion 71 (which in the specific embodiment shown is substantially vertical) and which is an integral part of the supporting element 70, and a wetted portion 72 extending rearward of the front decorated portion 71, and having a main inclination opposite to the inclination of the supporting elements in previously shown embodiments.

Generally, the primary dimension of the supporting elements need not be a straight line or straight line segment but could also be curved (provided their lower portions where the drops are forming/separating, is geometrically comprised by a substantially horizontal plane) or could comprise curved line segments.

The desired randomness effect of pulsation may also be maintained with embodiments, within the scope of the present invention, comprising supporting elements which in fact do not provide full randomness as regards the time sequence of points of formation of hanging/separating drops but which provide randomness within a series of predetermined points on the lower portion of the supporting elements.

FIG. 22 shows, in perspective view from the side, an example of a supporting element 80 with an irregularly shaped profile or front edge 81, with the lower portion or surface 82 inclined relative to the horizontal by an angle δ larger than zero degrees.

Drops 83 suspending from the lower surface 82 are formed at the tip of the protrusions 84 of the edge profile, due to inclination, according to a random sequence provided that all protrusions have their lower portion wetted by the film of liquid.

FIG. 23 illustrates an embodiment comprising a supporting element 90 containing liquid 91 which is transfered from within the supporting element through small openings 92 to the lower portion or lower surface 93 of the supporting element, due to the pressure of the liquid inside the supporting element; by flowing out from the openings 92 the liquid 91 will wet the lower portion 93 and form a film 94 of liquid from which drops 95 will form and separate in the randomlike manner according to the basic principle of the present invention. The supporting element 90 could be a segment of a pipe in which the liquid 91 is flowing under pressure (cf. arrow 96), or it could be a containerlike structure.

In the case of the liquid 91 being water a very low pressure, below 0.001 kg/cm$^2$ would already suffice to provide the desired pulsation by using circular openings having a diameter of 0.5 mm: under these conditions with a feed flow rate in the range of 350–500 ml/min. per 100 cm$^2$ of lower surface portion, a pulsation can be obtained with a checker-board pattern of holes spaced from each other 2.5 millimeters.

FIG. 24 illustrates an embodiment wherein the pronounced modification or change of the profile of the film of liquid on the lower portion at the sites where drops are forming/separating, is additionally exploited for optical effects by allowing transmission of light rays through the drops and refraction in the direction towards the observer, light rays which otherwise would be completely or almost completely reflected by the unmodified or only slightly modified portions of the film profile because the light would impinge at angles close or beyond the optical critical angle.

With a view to thus optically enhance the visual impact of the hanging-separating drops, in the embodiment illustrated in FIG. 24 the supporting element generally referred to at 100 is in the form of a pipe-like light guide structure capable of guiding light rays or light beams 101 entering at one end 102 of the structure, by the well-known phenomenon of 'lightpiping', i.e. successive (total) reflections at the inner walls of structure 100. Structure 100 comprises a substantially horizontally extending section 103 forming the supporting element proper within the context of the present invention, and a feed or entrance section 104 continuous with the supporting element section 103, and extending in a suitable direction for conveniently feeding light rays or beams 101 from a suitable light source. The entering light rays or light beams 101 will propagate through section 104 into (horizontal) supporting element section 103, by repeated multiple internal (total) reflection on the inner walls of structure 100, 104, 103. Horizontal section 103 serves the purpose of 'supporting element' in the sense of the present invention, i.e. supporting on the lower surface portion 105 thereof the liquid film 106 suspending therefrom, with drops 107 forming and separating from the suspending liquid film in the general manner contemplated and provided by the present invention. Structure 100 will consist of a suitable material (such as metal, glass or plastic material) with the inner walls being suitably finished to provide the required reflectivity for light-piping; section 103, at least in the lower surface portion thereof will consist of a transparent material, such as preferably a suitable glass or plastic material, whereby to allow the light travelling within and along the supporting element section 103 to exit to the liquid film 106 and drops 107 forming and separating therefrom, on the outside of the lower surface of section 103.

In accordance with a first alternative of this embodiment, the interior of structure 100 may only serve the purpose of lightpiping light rays and beams 101 to and along supporting element section 103. In accordance with a particularly interesting alternative embodiment element 100, being of a pipe-like structure anyway, may additionally serve the purpose of guiding liquid for feeding and replenishing liquid film 106; in this case, the supporting element section 103 of structure 100, at its lower surface portion supporting liquid film 106 may be provided with openings (not shown in FIG. 24, similar to openings 92 in FIG. 23) for transferring feed liquid from the inside of supporting pipe section 103 to the outside surface 105 to replenish film 106.

Thus, assuming appropriate geometry of illumination from one end 102 or both ends of the supporting structure 100, generating rays or beams 101 close to be parallel to the primary dimension (or axis) of the supporting element 100 and sections 104 and 103 thereof, this arrangement will allow to keep the light rays travelling along 100 inside the supporting element section 103 except at the sites where drops 107 are formed. Light rays 101 will hit the drops 107 after several reflections, such as against a smooth metal internal wall surface (total reflection) or against an interface glass or polymer with air, both materials having an index of refraction higher than the majority of considered liquids and consequently a lower critical angle (with air), thus 'keeping' the light rays inside the supporting element (and or liquid film 106) except where drops 107 are forming/separating.

The light rays will travel primarily inside the transparent body of the supporting element or, alternatively inside the liquid as the case may be in the two alternatives mentioned.

As explained, the pipe 100 conveying light and potentially feed liquid conveyed by the same pipe, in the transparent medium horizontally extending section 103 will serve as a supporting element; in the case of the light-pipe-only embodiment section 103 will be wetted only on the outside, in the second case (light-pipe and liquid feed pipe) it will be provided with openings for the transfer of the liquid from the inside to the outside; in both cases support section 103 will have a cross section size and profile following previously described geometries for obtaining the desired visual pulsation effect in accordance with the broad aspect of the present invention.

The embodiment of FIG. 24 may also be employed when using two liquids, one for forming the drops and one as surrounding medium, as previously described in connection with FIG. 6. In this case, obviously, the optical critical angle values to be considered are with respect to the second liquid: the surrounding medium.

From the foregoing description of FIG. 24 it will be clear that this embodiment allows to optically enhance the visual impact of hanging-separating drops.

The present invention involves as a basic feature the formation of a film of liquid on the lower portion, i.e. the lower surface, of a supporting element. This basic feature can be utilized for intentionally inducing movement of the hanging drop from the point of formation to a second point of subsequent separation, by a slight inclinination of the lower portion or surface of the supporting element. FIG. 25 illustrates as an example an arrangement embodying this feature. FIG. 25 shows in side elevation two groups of supporting elements 110,111,112 and 110*a*,111*a*,112*a*, with the two groups being arranged one above the other and the supporting elements in each group also being arranged one above the other, but additionally being staggered sidewise, whereby the point of separation of the drop from a particular supporting element in the group will overlap with the next adjacent supporting element below. The supporting elements are arranged such that their lower portion or surface will form an angle δ with the horizontal, as a means of urging the drops 113 to move during formation thereof evolving from their respective film of liquid 114 in a general direction corresponding to the inclination (from left to right in FIG. 25 as indicated by arrow M). In the arrangement shown each drop 113 will tend to move to the vertically lower areas of the lower portion, and separate therefrom near the lowermost part of the lower surface, as shown at 113 S and arrow F in FIG. 25. As this point of separation overlaps with the higher end portion of the next adjacent support element 112 below, film and drop formation on the lower portion of said element 112 will tend to start at the left end side, and under gravity caused by the inclination the drop will again move during formation thereof to the lower levels of the lower part of the support element 112. Thus, the generally vertical step-wise movements of the drops forming and separating from the lower surface of each support element to the next adjacent support element below will be superposed by a substantially horizontal component of gliding motion of the drops during their evolvement and formation on the lower portion of each supporting element.

This adds a visual feature but can also be used as a method of controlling the desired formation of the film of liquid. For best results the lower portions should have very high wettability property by the liquid such as several inorganic materials; rather low values of inclination angle δ by 0.5–1 degrees will already generate a noticeable amount of gliding motion of hanging drops. The motion pattern depends also from the cross-section profile of the supporting elements, and profiles such that the flow of liquid from the upper portion to the lower portion does not occur at discrete points are preferred.

While a particular arrangement of the (slightly inclined) supporting elements is shown in FIG. 25, other similar arrangements may be possible which will be apparent to those skilled in the art. E.g. the supporting elements might be arranged in a single vertical column one above the other, with each two adjacent supporting elements being inversely inclined relative to one another, whereby a kind of zigzagging motion of the drops during formation and separation will result, in superposition with the generally vertical dropping-down between successive supporting elements.

In the preceding, a broad variety of examples all embodying the basic principles of the present invention have been illustrated and described. Those embodiments, and variations thereof apparent to those skilled in the art, may be utilized for a vast variety of practical applications.

Some of these have already been described initially. Applications will include decorative surfaces (including arrangements and structures comprising more than one pulsation surface) for interior and out-door decoration, promotion and visual communication displays, stage designs for theatres, shows, concerts, TV advertisings including close-up views showing magnified drops, art and sculptural objects, etc., are applications employing visual surfaces which may range from as small as a few square centimeters, to as big as many square meters.

One interesting field of application is in connection with illumination devices and installations, e.g. for purposes of illuminating rooms.

Figure 26:
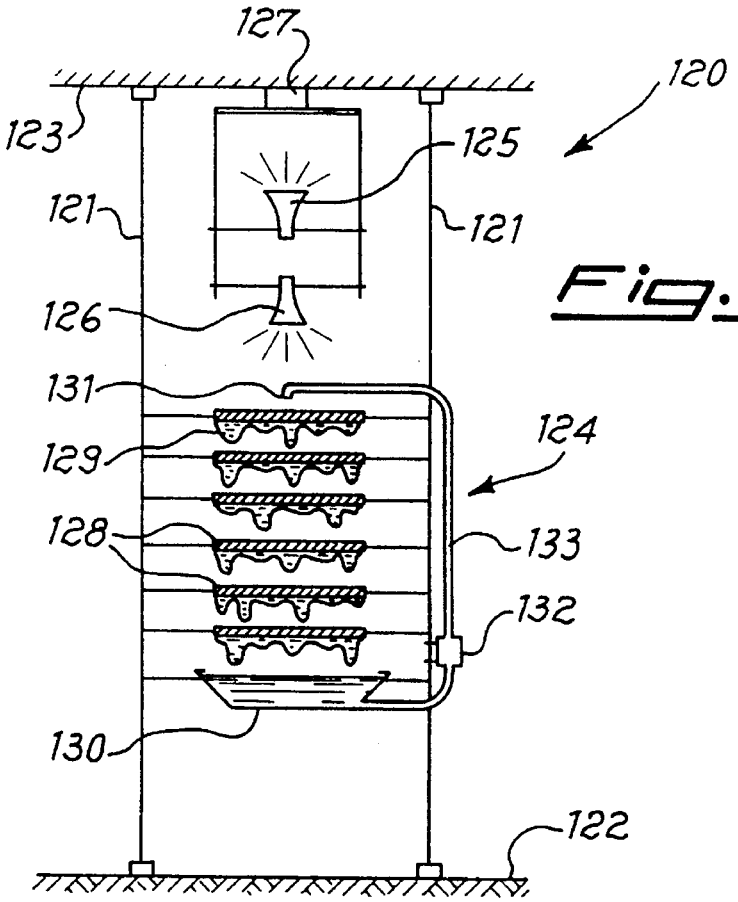

FIG. 26 illustrates an example of one such utilization in the form of a low voltage lamp device 120 for room lighting purposes, said device combining a structure embodying the pulsation effect of the present invention with suitable low voltage lamps. Two steel (or other suitable material) cables 121 fixed at the floor 122 and at the ceiling 123, respectively, support a device 124 according to the present invention, in association with two low voltage lamps: a diffuser lamp 125 facing upwards and a spot lamp 126 facing downwards, both connected with a transformer 127 through which the two lamps may also be suspended from ceiling 123. The invention part of the system includes a series of supporting elements 128 vertically stacked one above the other to provide the desired pulsation by a liquid 129 collected by a bottom container 130 and re-conveyed to the top 131 of the structure through a pipe 133 by means of a pump 132.

Figure 27:
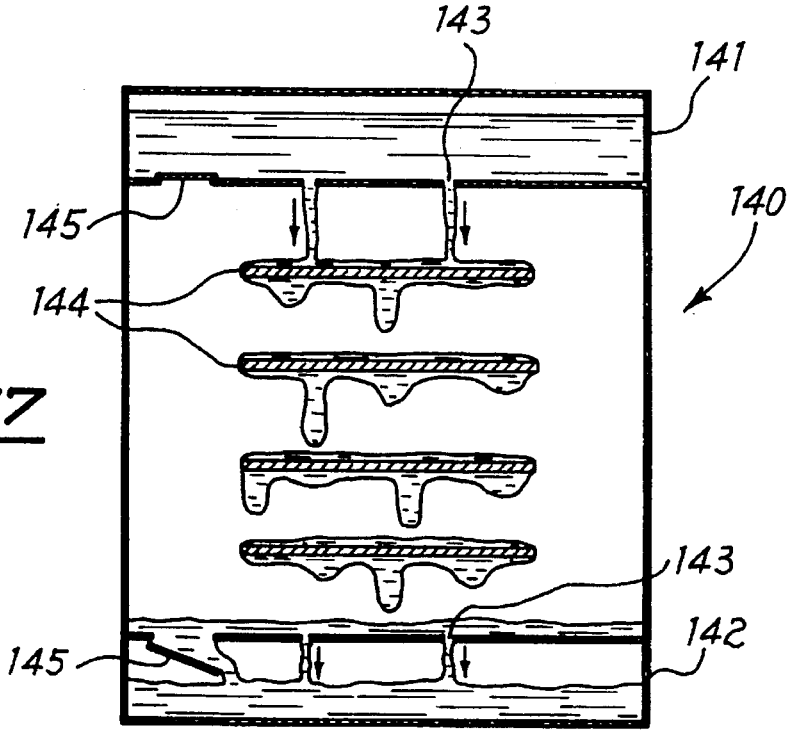

While most practical applications of the system of the invention will require the use of a pump and a hydraulic circuit comprising pipes for liquid circulation, there are some applications, such as table objects, which can dispense with the use of a pump. FIG. 27 shows, as an example, such an object 140 comprising an upper or top-container 141 and a lower or bottom container 142 both including openings 143, and, in between, a series of supporting elements 144 in accordance with the invention; the supporting elements 144 are provided with a cross-section profile such that they may function in up-side down position. After the liquid during a functional 'run' has filled the then lower or bottom container 142 the object is turned up-side down and pulsation starts again, with the previous bottom container 142 now operating as the new upper or top container, and previous upper or top container 141 now serving as the bottom container.

Pressure activated valves 145 can speed-up filling of the bottom container which otherwise would be initially slower than emptying of top container due to the difference in pressure.

In accordance with an interesting improvement or modification of the invention motion can be imparted to the supporting elements themselves.

FIG. 28 shows in side view, an example 150 embodying this modification. In FIG. 28, a series of supporting elements 151 generally conforming to the principles of the present invention are fixed or attached at their extremes to a couple of cables (or belts) 152 and travelling around, and driven by, two couples of guide and drive wheels or pulleys 153,154.

A container 155 containing the functional liquid 156 is provided at the lower end of the system in a manner that the supporting elements 151 moving with the supporting cables or belts 152 in the manner indicated by the arrows in FIG. 28, on their travel around the lower guide or drive pulleys 154 will dip into the functional liquid 156 and on emerging therefrom on their upwards travel leg (left leg in FIG. 28) will emerge therefrom wetted with the functional liquid 156, whereby during the upward leg of motion drops 157 will form/separate on/from the supporting elements in accordance with the present invention. Again, as regards feed of the liquid this embodiment is an entirely selfreplenishing system requiring no specific forced liquid circulation system, except the mechanical drive for mechanically moving cables 152 with support elements 151 around pulleys 153 and 154.

By suitably selecting the speed of motion of the string of support elements 151, in dependance on the cross-section profile of the supporting elements 151 and the wetting properties of the functional liquid 156 vis-a-vis the support elements, the desired pulsation effect is obtained by the drops forming/separating on/from the supporting elements.

The same or similar result could be obtained with a different kind of wetting device placed at a suitable bottom-(upwards motion) or top position (downwards motion).

A further embodiment adding a feature of mechanical movement of the support elements proper, to the overall random pulsation effect achieved by the present invention is illustrated in FIG. 29.

FIG. 29A shows, in side view, a swivably mounted supporting element 161 in two successive functional stages. The supporting element is swivable around a support hinge 162. Hinge support 162 is excentrically located (and/or the support element 160 provided with an unbalance relative to hinge 162) whereby the support element 161 will adopt an initial or rest position as shown in the left portion of FIG. 29A, wherein the longer (or heavier) arm 166 in the left portion of FIG. 29A rests upon a fixedly arranged stop 163, in a relatively inclined position. The functional liquid 164 on said support element will tend to form a film of liquid around the other (shorter and/or lighter) end 167 of element 161 and the drop 165 will tend to form on the lower surface of said lower end 167. Under the weight of the liquid and drop accumulating on that end the swivable support element 161 will tilt around hinge 162 into the position shown in the right portion of FIG. 29A. The drop 165 will separate from the support element 161 in this more inclined position from the lowermost end of element 161. After separation of the drop from the element, the latter will return to the initial or rest position shown in the left portion of FIG. 29A, for the next functional cycle of movement.

The final 'separation angle β' (FIG. 29A, right portion) corresponding to previously defined angle gamma (FIG. 4) should not exceed 40 degrees at the instant of drop separation, as previously taught for all embodiments.

FIG. 29B shows in front perspective view a system 160 including an array of supporting elements 161 as described, with a common rotation or hinge axis 162 and a common support or stop bar 163 for the elements 161 in one array.

Optimum pulsation randomness will be obtained by keeping the (axial) distance between the adjacent elements 161 very small (not more than 1.5 mm in the case of water as the operational liquid), in order to enable one continuous film of liquid to form along the length of the array 160, and the visual pulsation effect is further enhanced by the different orientation of those supporting element 161*a* (FIG. 29B) from which a hanging drop 165 is about to separate; such enhancement of the visual pulsation effect is brought about by means of an increase of the visual-cross section surface, contrast with the background, angle of reflection relative to a stationary light source, and other elementary or more sophisticated optical techniques.

This embodiment may, if desired, be modified into a system wherein the main or primary pulsation effect will be that of the random up-and-down movement of the supporting elements, rather than the formation or separation of liquid drops. In accordance with this modification pulsating surfaces may be created where the liquid (including the drops) is not visible due to masking elements such as 168 shown for the right-most supporting element 161*b* in FIG. 29B. Masking elements 168 would be part of the supported end 166 of the supporting element 161. The observer, looking at the embodiment from the side of the masking elements as indicated by arrow V in FIG. 29B and not from the side of the drops (as indicated by arrow D in FIG. 29B), would perceive a visual pulsation due to the up and down motion of the masking elements. As drop weights or volumes, depending on the selected liquid, may range from 15–20 microliters to 80–100 microliters, this embodiment may exact more precise tolerances in system layout and construction.

The present invention may also include an acoustical aspect: the sound of motion of liquids, such as water, is generally regarded as an agreeable, pleasant feature. The scope of the present invention also comprises structures providing a pleasant sound generated by the impact of the separating drops on a surface of selected acoustic properties, such surface e.g. being the upper portion of the adjacent supporting element below. Accordingly, if desired visual pulsation can be combined with acoustic pulsation. Furthermore, as the 'rhythm' of the pulsation can to a certain degree be controlled, the visual rhythmic properties of the pulsation can be combined with a suitably associated selected music rhythm produced by music instruments, electronic systems etc.

Alternatively, the visual pulsation effects obtained with the system of the invention can be achieved in substantially complete silence as the impact energies of the separated descending drops can be very low: this feature may be an important advantage in the case of applications where sound is not required or even disliked.

The invention has now been described as to the basic principles thereof and by means of a number of preferred embodiments and modifications. Other modifications and applications than those specifically described will be apparent to those skilled in the art, within the domaine of the present invention which is governed by the basic idea of obtaining a visual random-like pulsation effect distributed over a visual surface by providing one or more substantially horizontally extending suspending films of liquid under conditions which will cause the formation and subsequent separation of drops of that liquid from that suspending film(s) in a substantially random-like manner both as to the sites and the time sequence of formation/separation of said liquid drops. Accordingly, none of the specific features of the various embodiments described shall have a limitative effect on the broad aspect or scope of the invention which will be solely controlled and defined by the following claims.

What is claimed is:

1. A method of generating a visual pulsation effect distributed across a visual or display surface, wherein said visual or display surface comprises at least one supporting element extending along a substantially horizontal primary dimension across said visual or display surface, said at least one supporting element comprising a downward facing lower surface portion which is inclined at an angle γ (gamma) relative to the horizontal, said method comprising the steps of providing at least one suspending film of liquid on said downward facing lower surface portion of said at least one supporting element, feeding replenishing liquid to said at least one suspending film of liquid so as to cause distinct and individual drops of liquid to form, evolve and separate from said at least one suspending film of liquid at substantially random sites and times, said feeding of replenishing liquid being performed at a flow rate which maintains a constant amount of liquid in said at least one suspending film of liquid, further wherein said angle γ (gamma) of the lower surface portion of each supporting element, as averaged across the part wetted by said suspending film of liquid on that supporting element, relative to the horizontal, has a value that is less than 40°, said flow rate of replenishing liquid to the suspending film of liquid on said lower surface portion of each supporting element is less than 200 ml/min per each 100 mm length along the primary dimension of said suspending film of liquid, and said liquid has a viscosity value between 0.9 and 10 cPoise at 20° C., and a density value between 0.85 and 1.30 g/cm$^3$ at 20° C.

2. A system for generating and displaying a visual pulsation effect distributed across a visual or display surface, in accordance with the method of claim 1, the system comprising said at least one supporting element, means for forming said at least one suspending film of liquid on at least a part of the lower surface portion of the at least one supporting element, means for feeding said replenishing liquid to said at least one suspending film of liquid on said lower surface portion of said at least one supporting element.

3. The system of claim 2, wherein said liquid has a surface tension value, against air, of more than 60 mN/m, the suspending film of liquid on the lower surface portion of each supporting element has a cross-sectional length Ei, at right angles to the primary dimension, which has a value of more than 4.5 mm, and the lower surface portion of each supporting element has a critical surface tension CST value of more than 28 mN/m.

4. The system of claim 2, wherein said angle γ (gamma) is substantially 0°.

5. The system of claim 4, wherein said replenishing liquid has a surface tension value, against air, in the range between 40 and 60 mN/m, the suspending film of liquid on the lower surface portion of each supporting element has a cross-sectional length Ei, at right angles to the primary dimension, which has a value between 3.6 mm and 15 mm, and the lower surface portion of each supporting element has a critical surface tension CST value of more than 25 mN/m.

6. The system of claim 4, wherein said replenishing liquid has a surface tension value, against air, of less than 40 mN/m, the suspending film of liquid on the lower surface portion of each supporting element has a cross-sectional length Ei, at right angles to the primary dimension, which has a value between 2.1 mm and 9 mm, and the lower surface portion of each supporting element has a critical surface tension CST value of more than 20 mN/m.

7. The system of claim 4, wherein said liquid has a surface tension value, against air, of more than 60 mN/m, the suspending film of liquid on the lower surface portion of each supporting element has a cross-sectional length Ei, at right angles to said primary dimension, which has a value between 4.6 and 20 mm, and the lower surface portion of each supporting element has a critical surface tension CST value of more than 28 mN/m.

8. The system of claim 2, wherein said angle γ (gamma) is substantially 0°, the suspending film of liquid on the lower surface portion of each supporting element has a cross-sectional length Ei, at right angles to said primary dimension, which is chosen such as to span, together with said primary dimension of extension, an area of the suspending film of liquid on said lower surface portion of each supporting element which is sufficiently large to enable said formation, evolution and separation of drops of liquid to occur at sites distributed across two dimensions of said area, and wherein the flow rate of replenishing liquid to said suspending film of liquid on each supporting element is defined in terms of, and in relation to, said area of said suspending film of liquid and has a value of less than 1300 ml/min per each 100 cm$^2$ of said area wetted by said suspending film of liquid on each supporting element.

9. The system of claim 8, wherein said liquid has a surface tension value, against air, of more than 60 mN/m, said cross-sectional length Ei of said suspending film of liquid, at right angles to said primary dimension, has a value of more than 20 mm, and the lower surface portion of each supporting element has a critical surface tension CST value of more than 28 mN/m.

10. The system of claim 8, wherein said replenishing liquid has a surface tension value, against air, in the range between 40 and 60 mN/m, said cross-sectional length Ei of said suspending film of liquid, at right angles to the primary dimension, has a value of more than 15 mm, and the lower surface portion of each supporting element has a critical surface tension CST value of more than 25 mN/m.

11. The system of claim 8, wherein said replenishing liquid has a surface tension value, against air, of less than 40 mN/m, said cross-sectional length Ei of said suspending film of liquid, at right angles to the primary dimension, has a value of more than 9 mm, and the lower surface portion of each supporting element has a critical surface tension CST value of more than 20 mN/m.

12. The system of claim 2, wherein said liquid is water.

13. The system of claim 2, wherein said at least one supporting element comprises, at the part of the lower surface portion that is covered by said at least one suspending film of liquid, a porous structure.

14. The system of claim 2, wherein said at least one supporting element, said at least one suspending film of liquid comprised of a first liquid, and said drops of liquid forming, evolving and separating from said at least one suspending film of liquid, are submerged in a second liquid, and wherein said first liquid has a higher density than said second liquid, said second liquid is transparent, and said at least a part of the lower surface portion of the at least one supporting element is made of a material characterized by interfacial energies vis-a-vis the first liquid and the second liquid such that the difference in said interfacial energies is lower than the interfacial energy between the liquid and the second first liquid.

15. The system of claim 14, wherein said liquid is water and said second first liquid is a hydrocarbon possessing a low surface energy.

16. The system of claim 2, wherein said at least one supporting element comprises an upper surface portion, facing upwards, receiving said replenishing liquid for forming said at least one suspending film of liquid on said lower surface portion of said at least one supporting element, and wherein said replenishing liquid forms a film on said upper surface portion and is transferred from said upper surface portion to said lower surface portion at least one of (i) at least one edge connecting the upper surface portion and the lower surface portion of the at least one supporting element; ii) at least one opening connecting the upper surface portion and the lower surface portion.

17. The system of claim 2, wherein at least one of said at least one supporting element comprises an upper surface portion, facing upwards, shaped as a container apt to be filled with said replenishing liquid for forming said at least one suspending film of liquid on the lower surface portion of said at least one supporting element and wherein said replenishing liquid is transferred from said upper surface portion to said lower surface portion by means of at least one opening connecting the upper surface portion and the lower surface portion.

18. A system as claimed in claim 2, comprising a plurality of said supporting elements, including a top supporting element and a bottom supporting element, wherein the supporting elements are arranged one above the other with predetermined spacings between adjacent supporting elements, to form a vertically spaced array of supporting elements, whereby said visual or display surface is defined by said plurality of supporting elements viewed in front.

19. The system of claim 18, wherein the supporting elements in said vertically spaced array are arranged such that each supporting element, except the top supporting element, in said vertically spaced array receives said replenishing liquid for forming the suspending film of liquid on the lower surface portion thereof, from the adjacent supporting element above and each supporting element, except the bottom supporting element, provides said replenishing liquid to the adjacent supporting element below.

20. The system of claim 18, wherein the spacings between adjacent supporting elements, when measured as the average value along the primary dimension of each of said adjacent supporting elements, is between 7.0 and 20.0 mm and further wherein each supporting element has an upper surface portion which has a cross-sectional profile length Es at right angles with respect to the primary dimension of said supporting element, of not less than 5.0 mm.

21. The system of claim 18, wherein the sites where the drops of liquid separate from the at least one suspending film of liquid on the lower surface portions of the supporting elements in the array are contained in a vertical plane.

22. The system of claim 18, wherein the sites where the drops of liquid separate from the at least one suspending film of liquid on the lower surface portions of the supporting elements in the array are contained in a plane inclined relative to the vertical.

23. The system as claimed in claim 18, wherein a material display surface is associated with said array of supporting elements, said material display surface being arranged in front of said array of supporting elements and having openings aligned with said supporting elements through which the formation, evolution and separation of said drops of liquid can be seen by a viewer.

24. The system of claim 23, wherein said material display surface is embodied by strip-like elements unitary with each supporting element of said array, said strip-like elements associated with said array of supporting elements forming in their entirety said display surface.

25. The system of claim 2, wherein at least one of said at least one supporting element comprises at least one feature selected from the group consisting of an irregularly shaped profile and an irregularly shaped front edge.

26. The system of claim 2, wherein at least one of said at least one supporting element comprises a series of structurally predetermined sites where said drops of liquid form, evolve and separate from said at least one suspending film of liquid, further wherein said drops of liquid form, evolve and separate from said at least one suspending film of liquid at said structurally predetermined sites at random times.

27. The system of claim 2, wherein at least one of said at least one supporting element is shaped such as to have more than one lower surface portion each supporting a suspending film liquid from which said drops of liquid will form, evolve and separate.

28. The system of claim 27, wherein said at least one of said at least one supporting element has a cross-section which is crescent-shaped and has two depending distal ends, the two depending distal ends each supporting a suspending film of liquid with sites where the drops of liquid form, evolve and separate.

29. The system of claim 2, wherein at least one of said at least one supporting element internally contains said replenishing liquid for forming said suspending film of liquid on said lower surface portion of the at least one of said at least one supporting element, and wherein small openings are provided in said lower surface portion of said at least one of said at least one supporting element whereby to transfer said replenishing liquid under pressure through said openings to form said suspending film of liquid on said lower surface portion of said at least one of said at least one supporting element.

30. The system of claim 2, wherein said lower surface portion of at least one of said at least one supporting element consists of a transparent material whereby light transmitted through a light-guide from an external light-source is permitted to exit from within said at least one of said at least one supporting element at the sites of said lower surface portion where said drops of liquid form, evolve and separate.

31. The system of claim 30, wherein said at least one of said at least one supporting element embodies or has integrally associated therewith, a pipe for conveying at least one item selected from the group consisting of said replenishing liquid and said light from said external light source.

32. The system of claim 2, wherein the lower surface portion of at least one of said at least one supporting element is inclined so that a drop of liquid which initially forms and evolves from said at least one suspending film of liquid at a first point on said lower surface portion will eventually separate therefrom at a second point on said lower surface portion.

33. The system of claim 2, comprising a plurality of said supporting elements wherein the supporting elements are arranged one above the other and additionally are relatively staggered side-wise in a manner whereby the sites on the at least one suspending film of liquid where the drops of liquid separate from the at least one suspending film of liquid will overlap vertically with the next adjacent supporting element below.

34. The system of claim 2, wherein said at least one supporting element is movably mounted whereby to impart mechanical motion to said at least one supporting element in superposition with the visual pulsation effect achieved by the formation, evolution and separation of said drops of liquid from said at least one suspending film of liquid.

35. A system as claimed in claim 34, wherein said at least one supporting element is guided for movement along a closed path including at least one substantially vertically ascending leg, said closed path further including a dipping station comprising a container filled with said replenishing liquid, whereby said at least one supporting element travelling along said closed path will pass through said dipping station taking up said replenishing liquid therefrom which during further travel along said at least one substantially vertically ascending leg will form said at least one suspending film of liquid.

36. The system of claim 35, comprising a plurality of said supporting elements wherein said supporting elements are mounted on a flexible carrier means running over upper and lower guide and drive means, said lower guide means is associated with said dipping station, said driving means impart continuous movement to said flexible carrier means and said plurality of supporting elements mounted thereon, said supporting elements during their travel up said at least one substantially vertically ascending leg together define said visual or display surface.

37. A system in accordance with claim 34, wherein said at least one supporting element is provided with a capability of limited rotation around an axis which separates a first arm of said at least one supporting element from a second arm of said at least one supporting element, such rotation being caused by the weight, effective around said rotational axis, of a drop of liquid which forms and evolves from said at least one suspending film of liquid on the first arm of said at least one supporting element and said at least one supporting element returning to its original position due to the weight of the second arm of said at least one supporting element effective around said axis, after said drop of liquid separates from the at least one suspending film of liquid on the first arm of said at least one supporting element.

38. The system of claim 37, wherein said at least one supporting element comprises a plurality of supporting elements that are individually tiltably mounted side-by-side in a horizontal row on a common rotation axis.

39. A self-contained turn-around device embodying a system as claimed in claim 2, said device having an upper end and a lower end, wherein there is provided associated with the upper end of the device a first container for said replenishing liquid, including openings for feeding said replenishing liquid by gravity to a supporting element located at the upper end of said device to form said at least one suspending film of liquid, and wherein there is further provided, associated with the lower end of the device a second container for said replenishing liquid including openings for collecting said replenishing liquid from the drops of liquid that form, evolve and separate from said at least one suspending film of liquid, said replenishing liquid being successively discharged from said second container and fed by gravity to the supporting element located at the upper end of said device by turning the device upside down for a further cycle of operation of the device, with the first and second containers interchanging their function between successive cycles of operation.

40. A system in accordance with claim 2, further comprising at least one electrical lamp.

41. The system as claimed in claim 2, wherein said means for feeding said replenishing liquid to said at least one suspending film of liquid includes a pump and a hydraulic circuit.

42. A system as claimed in claim 2, further comprising sound generating means, whereby to combine the visual pulsation effect achieved by the formation, evolution and separation of said drops of liquid from said at least one suspending film of liquid, with acoustic pulsation.

43. The system of claim 42, wherein the sound generating means produces music.

44. The system of claim 2, wherein said replenishing liquid has a surface tension value, against air, in the range between 40 and 60 mN/m, the suspending film of liquid on the lower surface portion of each supporting element has a cross-sectional length Ei, at right angles to the primary dimension, which has a value of more than 3.5 mm, and the lower surface portion of each supporting element has a critical surface tension CST of more than 25 mN/m.

45. The system of claim 2, wherein said replenishing liquid has a surface tension value, against air, of less than 40 mN/m, the suspending film of liquid on the lower surface portion of each supporting element has a cross-sectional length Ei, at right angles to the primary dimension, which has a value of more than 2.0 mm, and the lower surface portion of each supporting element has a critical surface tension CST of more than 20 mN/m.

46. An object comprising a system for generating and displaying a visual pulsation effect distributed across a visual or display surface, in accordance with a method of generating said visual pulsation effect distributed across said visual or display surface, wherein said visual or display surface comprises at least one supporting element extending along a substantially horizontal primary dimension across said visual or display surface, said at least one supporting element comprising a downward facing lower surface portion which is inclined at an angle $\gamma$ (gamma) relative to the horizontal, said method comprising the steps of, providing at least one suspending film of liquid on said downward facing lower surface portion of said at least one supporting element, feeding replenishing liquid to said at least one suspending film of liquid so as to cause distinct and individual drops of liquid to form, evolve and separate from said at least one suspending film of liquid at substantially random sites and times, said feeding of replenishing liquid being performed at a flow rate which maintains a constant amount of liquid in said at least one suspending film of liquid, further wherein said angle $\gamma$ (gamma) of the lower surface portion of each supporting element, as averaged across the part wetted by said suspending film of liquid on that supporting element, relative to the horizontal, has a value that is less than 40°, said flow rate of replenishing liquid to the suspending film of liquid on said lower surface portion of each supporting element is less than 200 ml/min per each 100 mm length along the primary dimension of said suspending film of liquid, and said liquid has a viscosity value between 0.9 and 10 cPoise at 20° C., and a density value between 0.85 and 1.30 g/cm$^3$ at 20° C., the system comprising said at least one supporting element, means for forming said at least one suspending film of liquid on at least a part of the lower surface portion of the at least one supporting element, means for feeding said replenishing liquid to said at least one suspending film of liquid on said lower surface portion of said at least one supporting element.

* * * * *

UNITED STATES PATENT AND TRADEMARK OFFICE

CERTIFICATE OF CORRECTION

PATENT NO. : 5,600,907
DATED : February 11, 1997
INVENTOR(S) : Helmut Eigenmann

It is certified that error appears in the above-identified patent and that said Letters Patent is hereby corrected as shown below:

In Column 22, line 57 (Claim 14), "first" should be inserted after "between the" and in line 58, "first" should be deleted.

In Column 23, line 2 (Claim 16), "at " should be inserted after "surface portion" and before "at".

In Column 24, line 11 (Claim 27), "of" should be inserted after "film".

In Column 24, line 14 (Claim 28), the phrase "at right angles to the primary dimension" should be inserted after "cross-section".

Signed and Sealed this

Sixth Day of January, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,600,907

DATED : February 11, 1997

INVENTOR(S) : HELMUT EIGENMANN

It is certified that error appears in the above-identified patent and that said Letters Patent is hereby corrected as shown below:

In Column 23, line 5 (claim 16), "ii)" should read --and (ii)--.

Signed and Sealed this

Seventeenth Day of March, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,600,907
DATED : February 11, 1997
INVENTOR(S) : Helmut Eigenmann

It is certified that error appears in the above-identified patent and that said Letters Patent is hereby corrected as shown below:

In Column 22, line 59 (Claim 15), "first" should be inserted after "wherein said" and in line 60, "first" should be deleted.

Signed and Sealed this

Twelfth Day of January, 1999

*Attest:*

*Attesting Officer*

*Acting Commissioner of Patents and Trademarks*